US006324355B1

(12) United States Patent
Matsui et al.

(10) Patent No.: US 6,324,355 B1
(45) Date of Patent: Nov. 27, 2001

(54) IMAGE FORMING APPARATUS WITH CONTROL BASED ON THICKNESS OF CONVEYING BELT

(75) Inventors: Norio Matsui, Mishima; Atsushi Munakata, Yokohama, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/510,151

(22) Filed: Feb. 22, 2000

(30) Foreign Application Priority Data

Feb. 23, 1999 (JP) ..... 11-045540
Feb. 16, 2000 (JP) ..... 12-037726

(51) Int. Cl.[7] ..... G03G 15/00
(52) U.S. Cl. ..... 399/38; 399/167; 399/303
(58) Field of Search ..... 399/38, 39, 40, 399/41, 162, 165, 167, 302, 303, 306; 474/11, 70; 198/790, 792, 804, 810.01, 810.03

(56) References Cited

U.S. PATENT DOCUMENTS 5,674,019 10/1997 Munakata et al. ..... 400/568
5,708,933 * 1/1998 Nogami et al. ..... 399/167
5,743,521 4/1998 Munakata et al. ..... 271/263
6,038,423 * 3/2000 Tagawa et al. ..... 399/301
6,115,572 * 9/2000 Edwards et al. ..... 399/162
6,157,799 * 12/2000 Asakura et al. ..... 399/167

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

An image forming apparatus includes a plurality of image bearing members, an image forming device for forming images of plural colors on the plurality of image bearing members, a recording material conveying belt for bearing and conveying a recording material thereon, a drive roller for transmitting a driving force to the recording material conveying belt, the images of plural colors on the plurality of image bearing members formed by the image forming device being successively transferred to the recording material formed on the recording material conveying belt in superposed relationship with one another, and a control device for controlling the rotating speed of the drive roller on the basis of the thickness information of the recording material conveying belt in the direction of movement of the recording material conveying belt.

66 Claims, 17 Drawing Sheets

FIG. 10

| | BLOCK 1 | BLOCK 2 | BLOCK 3 | BLOCK 4 | BLOCK 5 | BLOCK 6 |
|---|---|---|---|---|---|---|
| AVERAGE THICKNESS | 75.707 | 76.336 | 77.578 | 79.853 | 83.541 | 87.053 |
| FLUCTUATION IN THICKNESS | −3.837 | −3.209 | −1.967 | 0.308 | 3.997 | 7.508 |
| FLUCTUATION IN SPEED | −0.015 | −0.012 | −0.008 | 0.001 | 0.015 | 0.029 |
| MISREGISTERING AMOUNT | −0.008 | −0.007 | −0.004 | 0.001 | 0.008 | 0.016 |
| CORRECTING VALUE | 1 | 0 | 1 | 0 | 0 | −2 |
| MISREGISTERING AMOUNT | 0.000 | −0.007 | −0.004 | −0.003 | 0.006 | 0.006 |

| BLOCK 7 | BLOCK 8 | BLOCK 9 | BLOCK 10 | BLOCK 11 | BLOCK 12 | BLOCK 13 | BLOCK 14 | BLOCK 15 | BLOCK 16 |
|---|---|---|---|---|---|---|---|---|---|
| 86.140 | 80.273 | 77.343 | 77.446 | 78.519 | 79.432 | 79.532 | 79.188 | 78.283 | 76.484 |
| 6.595 | 0.729 | −2.201 | −2.098 | −1.025 | −0.112 | −0.012 | −0.356 | −1.261 | −3.060 |
| 0.025 | 0.003 | −0.008 | −0.008 | −0.004 | 0.000 | 0.000 | −0.001 | −0.005 | −0.012 |
| 0.014 | 0.002 | −0.005 | −0.004 | −0.002 | 0.000 | 0.000 | −0.001 | −0.003 | −0.006 |
| −2 | 0 | 0 | 0 | 0 | 0 | 0 | 0 | 1 | 1 |
| 0.004 | 0.006 | 0.001 | −0.003 | −0.005 | −0.006 | −0.006 | −0.006 | −0.001 | 0.000 |

FIG. 16

| | BLOCK 1 | BLOCK 2 | BLOCK 3 | BLOCK 4 | BLOCK 5 | BLOCK 6 |
|---|---|---|---|---|---|---|
| AVERAGE THICKNESS | 75.707 | 76.336 | 77.578 | 79.853 | 83.541 | 87.053 |
| FLUCTUATION IN THICKNESS | −3.837 | −3.209 | −1.967 | 0.308 | 3.997 | 7.508 |
| FLUCTUATION IN SPEED | −0.015 | −0.012 | −0.008 | 0.001 | 0.015 | 0.029 |
| CORRECTING VALUE (DIGIT) | 1 | 0 | 0 | 0 | −1 | −2 |
| FLUCTUATION IN SPEED AFTER CORRECTION | −0.001 | −0.012 | −0.008 | 0.001 | 0.001 | 0.001 |

| BLOCK 7 | BLOCK 8 | BLOCK 9 | BLOCK 10 | BLOCK 11 | BLOCK 12 | BLOCK 13 | BLOCK 14 | BLOCK 15 | BLOCK 16 |
|---|---|---|---|---|---|---|---|---|---|
| 86.140 | 80.273 | 77.343 | 77.446 | 78.519 | 79.432 | 79.532 | 79.188 | 78.283 | 76.484 |
| 6.595 | 0.729 | −2.201 | −2.098 | −1.025 | −0.112 | −0.012 | −0.356 | −1.261 | −3.060 |
| 0.025 | 0.003 | −0.008 | −0.008 | −0.004 | 0.000 | 0.000 | −0.001 | −0.005 | −0.012 |
| −1 | 0 | 0 | 0 | 0 | 0 | 0 | 0 | 0 | 0 |
| 0.011 | 0.003 | −0.008 | −0.008 | −0.004 | 0.000 | 0.000 | −0.001 | −0.005 | −0.012 |

IMAGE FORMING APPARATUS WITH CONTROL BASED ON THICKNESS OF CONVEYING BELT

BACKGROUND OF THE INVENTION

1. Field of the Invention

This invention relates to an image forming apparatus using the electrophotographic process, and particularly to an image forming apparatus such as a copier, a printer or a facsimile apparatus.

2. Related Background Art

An image forming apparatus adopting the electrophotographic process has a plurality of image forming portions for forming latent images on photosensitive drums which are image bearing members by the utilization of light, magnetism, charges or the like, and visualizing the latent images to thereby obtain visible images, transfer material conveying means for conveying a transfer material to a transfer position of each image forming portion, and fixing means for fixing the image transferred onto the transfer material on the transfer material.

As the transfer material conveying means, use is often made of a belt-shaped conveying member, i.e., a transfer material conveying belt (hereinafter simply referred to as the "conveying belt") from the viewpoint of the conveying property, and it conveys the transfer material to the transfer position, and further to the fixing device. At this time, the transfer material is retained on the conveying belt by an electrostatic attractive force and is conveyed.

The conveying belt is passed over, supported and moved by a drive roller (drive rotary member) and at least one driven roller (driven rotary member).

Contrivance is made such that the conveying belt is extended with a constant force between the drive roller and the driven roller, and the conveying belt is moved at a constant speed from the most upstream image forming portion to the most downstream image forming portion without slackening between the two rollers.

The transfer material is electrostatically attracted to the conveying belt as previously described, and is conveyed to each image forming portion while being retained on the conveying belt, and a toner image of each color is transferred to the transfer material, and is fixed at fixing means, whereby a full color image can be obtained.

Also, the conveying belt is provided with deviation regulating means for blocking the deviation of the belt (the movement of the belt on the roller shaft in a direction orthogonal to the driving direction) by the extraneous force during long-time rotation or jam clearance to thereby prevent the belt from falling off the rollers.

The image forming process in an image forming apparatus according to the conventional art will now be described specifically with reference to FIG. 23 of the accompanying drawings. FIG. 23 schematically shows an example of a full color image forming apparatus according to the conventional art.

First, second, third and fourth image forming portions Pa, Pb, Pc and Pd are juxtaposed in the main body of the image forming apparatus. Below the first to fourth image forming portions Pa to Pd from cassettes 107*a* and 107*b* containing transfer materials therein to a fixing device 111 in the main body of the image forming apparatus, there is provided an endless belt-shaped transfer material conveying means, i.e., a conveying belt 108, circulatorily moved to convey the transfer material through these image forming portions Pa–Pd. This conveying belt 108 is passed over a driven roller 109 and a drive roller 110. Further, the driven roller 109 is provided with tension imparting means 109*t* for imparting tension to the conveying belt 108, and deviation regulating means, not shown.

The conveying belt 108 is a thin belt of a dielectric material driven in the direction indicated by the arrow A by the drive roller 110 rotated by a drive motor, e.g. a stepping motor 120, and bears thereon the transfer material fed out of the cassette 107*a* or 107*b* and fed in synchronism with image formation by a pair of registration rollers 100, and the transfer material is conveyed to the afore described image forming portions Pa–Pd in succession. The fixing device 111 receives the transfer material discharged from the drive roller 110, and collectively fixes toner images of respective colors transferred to the transfer material in superposed relationship with one another at the image forming portions Pa–Pd to thereby form a permanent image.

Each portion of the image forming apparatus will now be described in detail. The image forming portions Pa–Pd have substantially the same construction, and include photosensitive drums 101*a*, 101*b*, 101*c* and 101*d* which are image bearing members rotatively driven in the direction indicated by arrow B, and primary chargers 102*a*, 102*b*, 102*c* and 102*d* for uniformly is charging the photosensitive drums 101*a*–101*d*, respectively, developing devices 103*a*, 103*b*, 103*c* and 103*d* for developing electrostatic latent images formed on the photosensitive drums 101*a*–101*d*, respectively, transfer chargers 104*a*, 104*b*, 104*c* and 104*d* for transferring the developed toner images of respective colors to the transfer material, and cleaning devices 105*a*, 105*b*, 105*c* and 105*d* for removing the toners remaining on the photosensitive drums 101*a*–101*d*, respectively, are successively disposed around the respective photosensitive drums 101*a*–101*d* in the direction of rotation thereof (the direction indicated by the arrow B). Exposing optical systems 106*a*, 106*b*, 106*c* and 106*d* are provided above the photosensitive drums 101*a*–101*d*, respectively.

Yellow (Y) toner, magenta (M) toner, cyan (C) toner and black (K) toner are contained in the developing devices 103*a*, 103*b*, 103*c* and 103*d*, respectively.

In the above-described full color image forming apparatus, when a transfer material is placed on the conveying belt 108, the image forming processes for the corresponding photosensitive drums 101*a*–101*d* are successively started with the movement of the conveying belt 108 in the direction indicated by the arrow A. That is, a yellow image is formed on the photosensitive drum 101*a* of the first image forming portion Pa, a magenta image is formed on the photosensitive drum 101*b* of the second image forming portion Pb, a cyan image is formed on the photosensitive drum 101*c* of the third image forming portion Pc, and a black image is formed on the photosensitive drum 101*d* of the fourth image forming portion Pd.

The transfer material passes below the photosensitive drums 101*a*–101*d* in the first to fourth image forming portions Pa–Pd and is conveyed toward the fixing device 111 by the movement of the conveying belt 108, and the toner images of the respective colors are transferred to the transfer material in superposed relationship with one another by the transfer chargers 104*a*–104*d* of the image forming portions Pa–Pd, whereby a full color image is formed.

The transfer material passes through the last fourth image forming portion Pd, whereafter it is separated from the conveying belt 108 and is sent to the fixing device 111, in which the toner images of the respective colors transferred in superposed relationship with one another are fused and fixed, whereafter the transfer material is discharged to a discharge tray 112.

However, with the ideal conveying speed of the conveying belt 108 as the premise, latent images are formed on the corresponding photosensitive drums 101*a*–101*d* at exposing time intervals corresponding to desired image information, whereby a desired transferred image ought to be formed on the transfer material, but since there are the following problems, positional deviation may occur to the transferred image to deteriorate the quality of the image.

The following two points become great problems in driving the conveying belt 108 so as to assume an ideal conveying speed.

(1) The conveying speed of the transfer material conveyed by the conveying belt 108 is sequentially changed by the geometrical shape difference or the like of the drive roller 110 or between the drive roller 110 and the driven roller 109 and therefore, in the image sequentially formed on the transfer material, a fluctuation occurs to the image in the direction of movement of the conveying belt and the quality of the image formed on the transfer material is liable to be deteriorated.

The speed V of the surface of the conveying belt prescribed by the drive roller 110 having a radius r driven at a predetermined angular speed w and the thickness h of the conveying belt 108 is represented as follows:

$$V=(r+h/2)\cdot w \quad (1)$$

When eccentricity Δr is superposed on this drive roller 110, the speed fluctuation ΔV of the conveying speed V prescribed by the drive roller 110 is represented as follows:

$$\Delta V_w=\Delta r_w\cdot w \quad (2)$$

By the speed fluctuation ΔV by the eccentricity of this drive roller, the transferred image causes misregister, i.e., misregister of colors.

However, such misregister of the period of the drive roller creates misregister having the similar periodicity of the respective colors by making, for example, the diameter of the drive roller equal to the photosensitive drum pitch, but it is possible to suppress the creation of the misregister among the respective colors.

(2) Also by the fluctuation of the conveying belt 108 in the direction of thickness thereof over the full circumferential length thereof, a change occurs to the conveying speed of the transfer material prescribed by the drive roller 110, and this has led to the problem that with the deterioration of the quality of image in which the image on a single transfer material deviates from an ideal position, a fluctuation also occurs to the images on a plurality of transfer materials and the repetitive positional reproducibility among the transfer materials is deteriorated.

Assuming that for example, a thickness fluctuation Δh exists over the full circumferential length in the thickness h of the conveying belt wound on the drive roller 110 having a radius r and driven at a constant angular speed w, the speed fluctuation ΔV in the speed V of the conveying belt prescribed by the drive roller 110 is represented as follows:

$$\Delta V_L=\Delta h_L\cdot w \quad (3)$$

L: the period of the full circumferential length of the belt

The relation between the fluctuation in the linear speed of the conveying belt prescribed by the drive roller 110 of the conveying belt and the positional deviation of the image formed thereby can be typically represented as shown in FIG. 24 of the accompanying drawings.

The axis of abscissas indicates time t, the axis of ordinates indicates the fluctuation v in the linear speed of the conveying belt, small letters y1–k1 indicate exposure timing, and the manner in which capital letters Y1–K1 are transferred to the first transfer material T1 is typically shown. At this time, the position of the exposed image on the transfer material is indicated by continuous cross lines like +++++ so as to be capable of being distinctly discriminated.

This is singly effected, or is repetitively carried out up to a suffix n. Also, at this time, the full circumferential length of the conveying belt 108 corresponds to L.

A state in which the positional deviation (misregister of colors) of the toner images of respective colors attributable to the fluctuation of the speed based on the fluctuation of the thickness of the conveying belt 108 in the circumferential direction thereof occurs in T1, T2, . . . , Tn and the positional deviation also occurs between T1–T2 and between T2–Tn is shown as the position of arrows Y1–K1, and typically shows that the interval between the cross lines is an unequal interval.

At this time, a fluctuation indicated by solid line L1 which is a fine AC component in the fluctuation in the speed of the conveying belt corresponds to item (1) above, and a large undulating component indicated by broken line corresponds to item (2) above.

SUMMARY OF THE INVENTION

It is an object of the present invention to provide an image forming apparatus which can prevent the misregister colors of an image formed on a belt member or a recording material borne on the belt member.

Other objects of the present invention will become apparent from the following detailed description when read with reference to the accompanying drawings.

BRIEF DESCRIPTION OF THE DRAWINGS

FIG. 10 shows a calculated speed control correcting value of the belt member.

FIG. 16 shows a calculated speed control correcting value of the belt member.

DESCRIPTION OF THE PREFERRED EMBODIMENTS

Some embodiments of the present invention will hereinafter be described with reference to the drawings.

Embodiment 1

Figure 1:
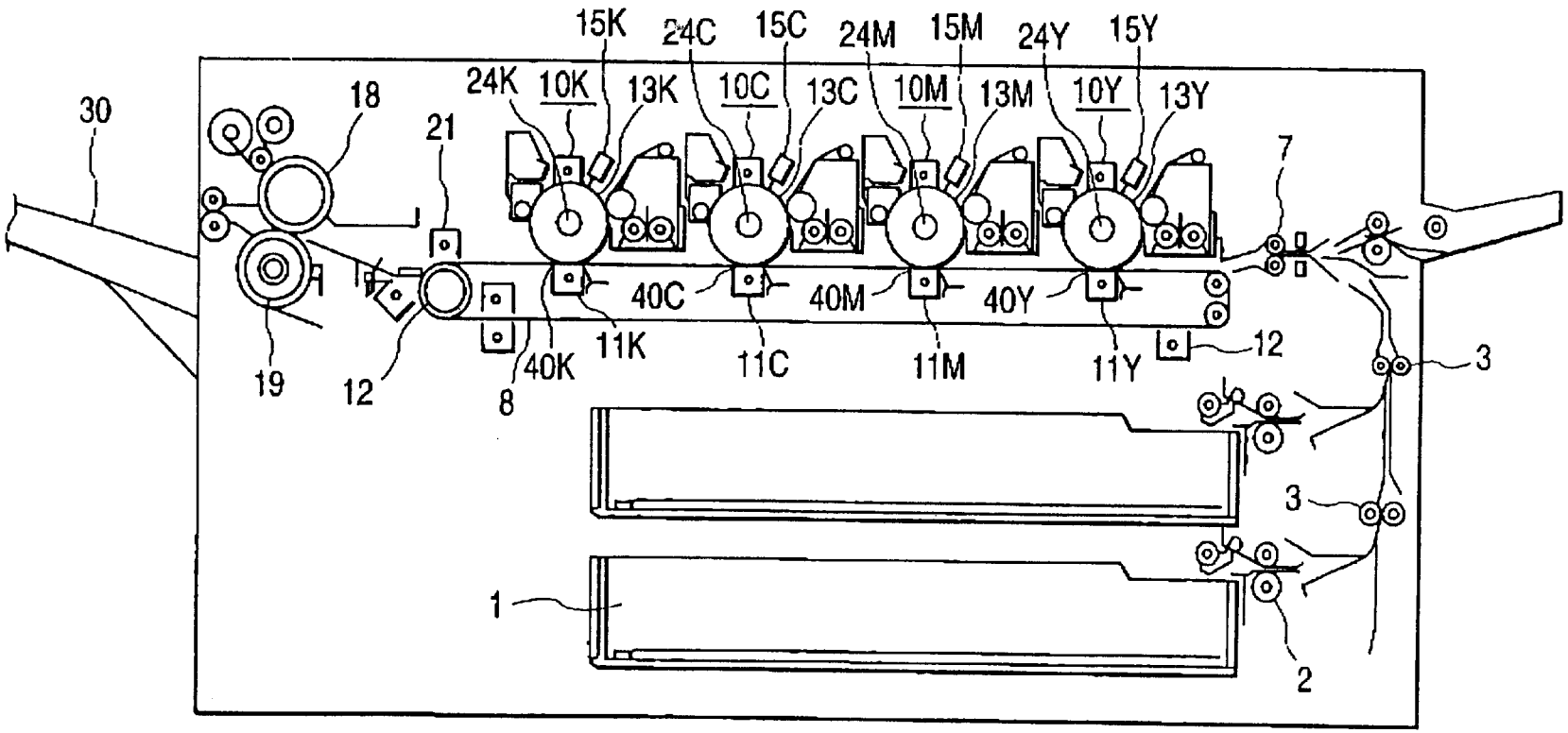
FIG. 1 is a cross-sectional view of essential portions of an image forming apparatus to which the present invention is applied.

FIG. 1 schematically shows a construction of an image forming apparatus according to Embodiment 1 of the present invention.

The reference characters 10C, 10M, 10Y and 10K designate cyan, magenta, yellow and black image forming portions, respectively, and the reference numeral 8 denotes a transfer belt as a recording material conveying belt.

Recording paper as a recording material contained in a cassette 1 is fed by a feed roller 2, whereafter it is conveyed by a pair of conveying rollers 3 and arrives at a pair of registration rollers 7. The recording paper has its skew-feed or the like corrected by the pair of registration rollers 7 and is fed out toward the transfer belt 8 in timed relationship with image formation. The transfer belt 8 is made of a sheet material of resin, and is driven by a drive motor 20 through a transfer belt driving roller 12. The reference characters 11C, 11M, 11Y and 11K denote transfer chargers for charging the surface of the sheet from below the transfer belt 8 and effecting image transfer.

By an image information signal sent from an original reading apparatus (not shown) or an output apparatus (not shown) such as a computer, latent images corresponding to respective colors are formed on photosensitive drums 13C, 13M, 13Y and 13K as image bearing members. The recording paper fed out by the pair of registration rollers 7 is electrostatically attracted to the charged transfer belt 8, and is conveyed under the image forming units 10C, 10M, 10Y and 10K by the transfer belt 8.

Figure 2:
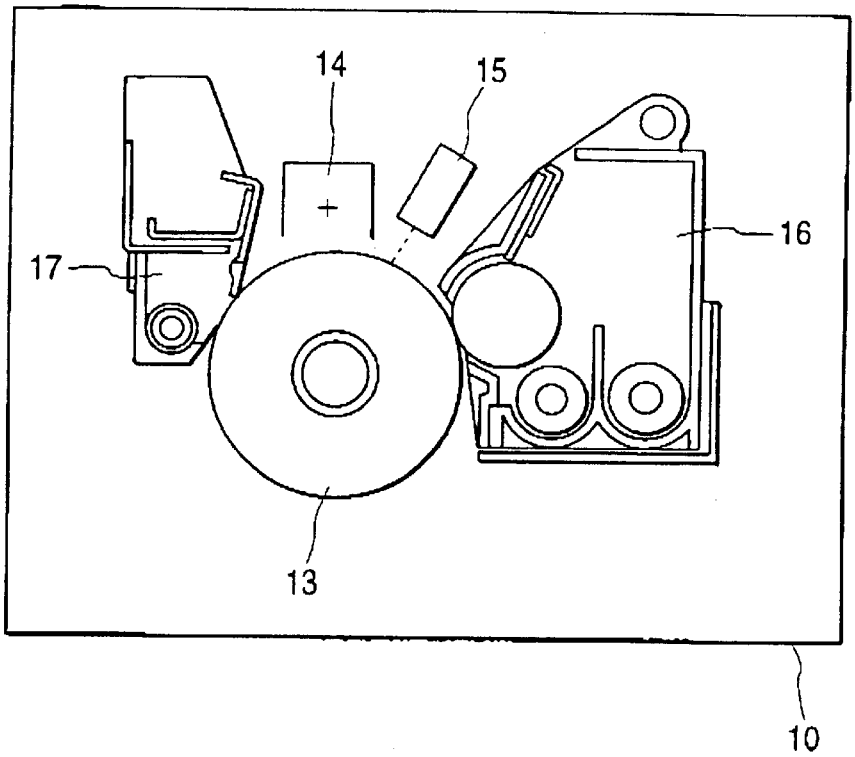
FIG. 2 is a cross-sectional view of essential portions of the image forming unit of the image forming apparatus to which the present invention is applied.

Each image forming unit 10 detachably mountable to the main body of the apparatus has a charger 14, a developing device 16 and a cleaner 17 disposed around the photosensitive drum 13, as shown in FIG. 2, and exposes the surface of the photosensitive drum charged by the charger 14, by each exposure device 15 fixed onto the main body, and the formed latent image is developed by the developing device 16, whereby a toner image of each color is formed on the surface of the photosensitive drum 13.

At transfer positions 40Y–40K, the images of respective colors are successively transferred to the recording paper electrostatically attracted to and conveyed by the transfer belt 8, in superposed relationship with one another. The recording paper to which the four colors have been transferred is separated from the transfer belt 8 by a separation charger 21, and arrives at a pair of fixing rollers 18 and 19. The fixing roller 18 is heated by a heater (not shown), and the toners of respective colors are thermally fused and fixed on the recording paper, whereby a color image is completed. The recording paper on the surface of which the toner images have been fixed by the pair of fixing rollers 18 and 19 is discharged onto a discharge tray 20 protruding out of the apparatus.

In the present apparatus, the image forming units are positioned by photosensitive drum shafts 24Y–K, as shown in FIG. 1, and the distance between adjacent ones of the image forming units (the distance between the transfer positions) is about 96.13 mm.

The diameter of the drive roller 12 is about 30.6 mm (=circumferential length 96.13 mm) so that misregister of colors may not occur even when the linear speed of the transfer belt 8 is changed by the eccentricity of the drive roller 12. In the present embodiment, the circumferential length of the transfer belt 8 is 1037 mm, the peripheral speed of the belt is 117 mm/sec., and the time required for the transfer belt to make a round is about 8.9 sec.

Figure 3:
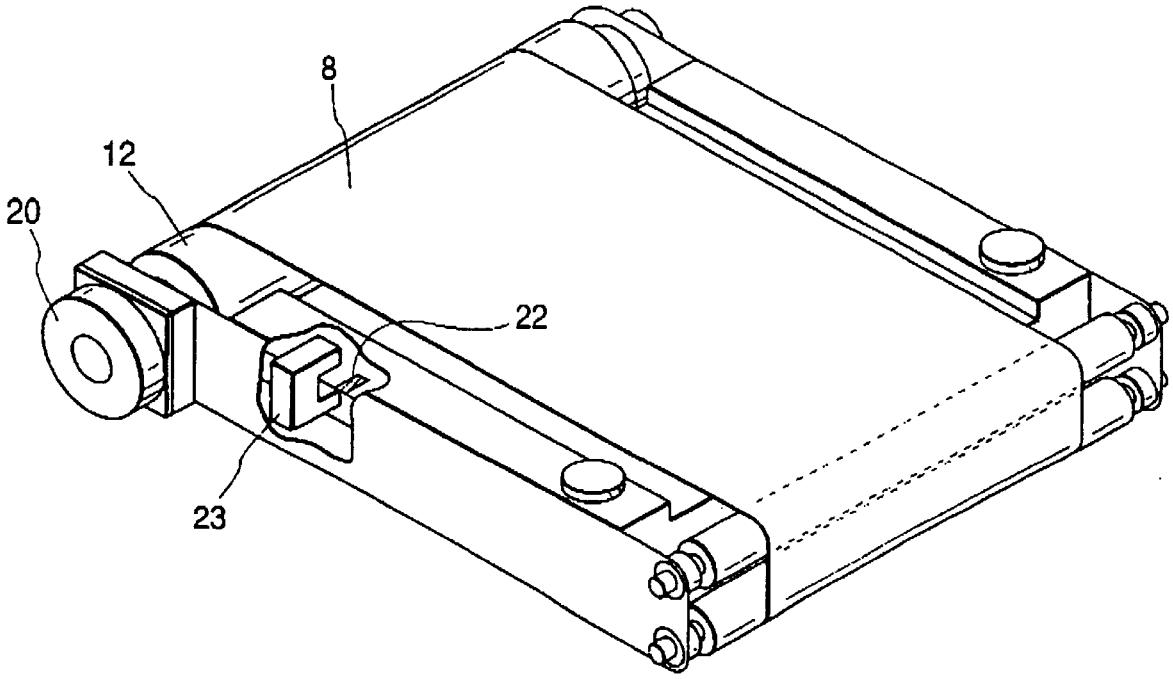
FIG. 3 is a perspective view showing a transfer unit of the image forming apparatus to which the present invention is applied.

FIG. 3 shows a perspective view of the transfer unit. The reference numeral 20 designates a vibration motor for driving the belt, and this motor 20 is directly connected to the belt driving roller 12 to reduce the transmission error by the driving system. The driving force of the motor 20 is controlled by a driving circuit on the basis of a frequency signal or an encoder frequency obtained from an encoder (1000 pulses/rotation) contained therein.

The reference numeral 22 denotes a marking painted on the end portion of the transfer belt 8 for detecting the home position of the belt, and the edge of this marking is detected by a transmission type photosensor 23 mounted on the main body to thereby detect the home position of the transfer belt 8.

During the formation of a full color image, after the lapse of a predetermined time period from a time when exposure has been started on the photosensitive drum 13Y by the exposure device 15Y, exposure is started on the photosensitive drum 13M by the next exposure device 15M. After the next step, exposure is started at a similar time interval, and toner images may be successively transferred onto the recording material.

Figure 4A:
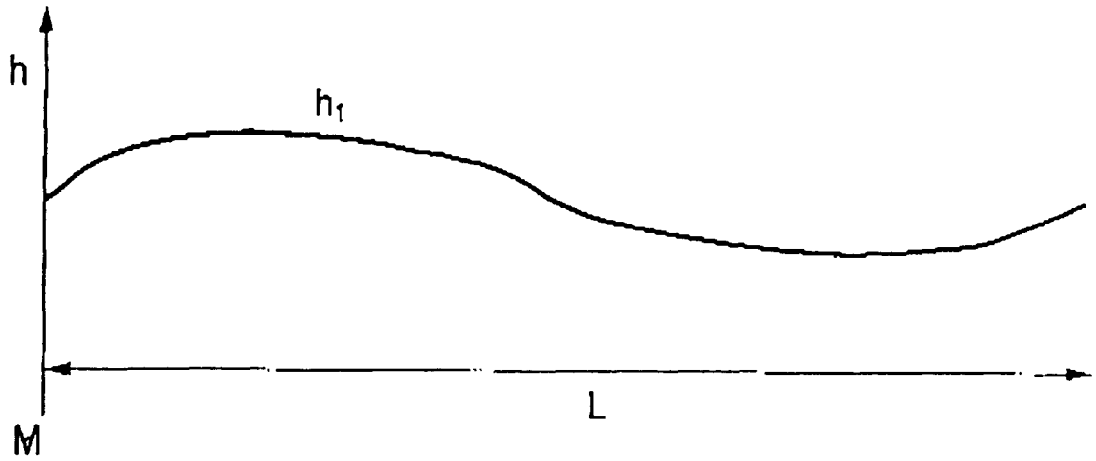
FIG. 4A is a graph showing a thickness profile of a belt.

The transfer belt 8 is formed by the centrifugal molding method, and before it is incorporated into the main body, the thickness profile (uneven thickness) of the transfer belt 8 over the full circumference thereof is measured in advance and is stored in a ROM as memory means. Here, assuming that the transfer belt 8 has been molded via the same manufacturing process, it is empirically known that the belt is molded so that the belt profile may be of a substantially similar shape in this side portion, the central portion and the inner side portion in FIG. 1 and also the profile in the direction of the full circumference of the belt becomes substantially similar. So, the typical thickness profile over one round (L) of the belt is shown in FIG. 4A.

For the respective transfer belt members having these similar profiles, at a position whereat the thickness profile in the direction of the full circumference thereof indicates a similar phase, the above-described marking 22 is put as a reference mark which is the home position.

The reference position for the full circumferential length of the transfer belt member is recognized by the sensor 23, and the base point of one round of the transfer belt is determined.

Figure 4B:
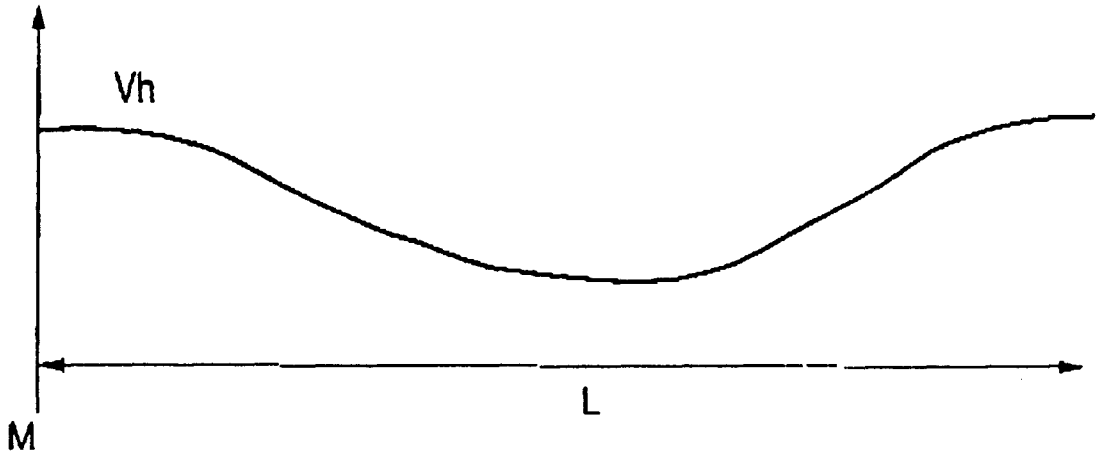
FIG. 4B is a graph showing a speed profile created by an uneven thickness of the belt.

By the transfer belt unit being set in the apparatus with such a thickness profile hl in the direction of full circumference controlled, it becomes possible for all the transfer belt members to set a similar thickness profile hl in the direction of full circumference with the position detected by the home position mark 22 as the reference, and a speed fluctuation amount Vh created by the thickness direction profile hl over the full circumference prescribed by the drive roller 12 can be foreseen in advance by calculation. An example of the distribution of the speed fluctuation amount Vh over one round (L) of the belt is shown in FIG. 4B.

Figure 5A:
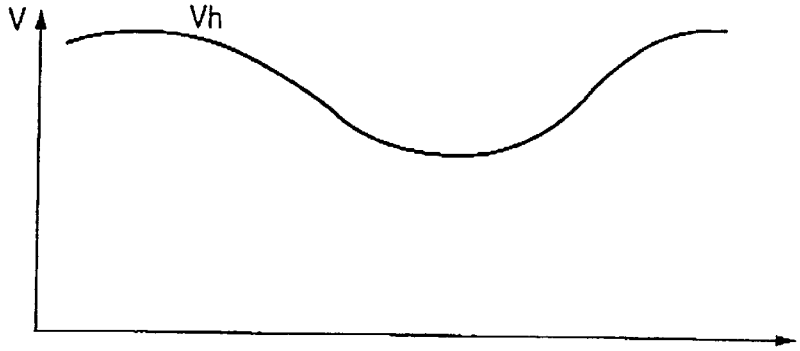
FIG. 5A is a graph showing the speed profile of the belt.
Figure 5B:
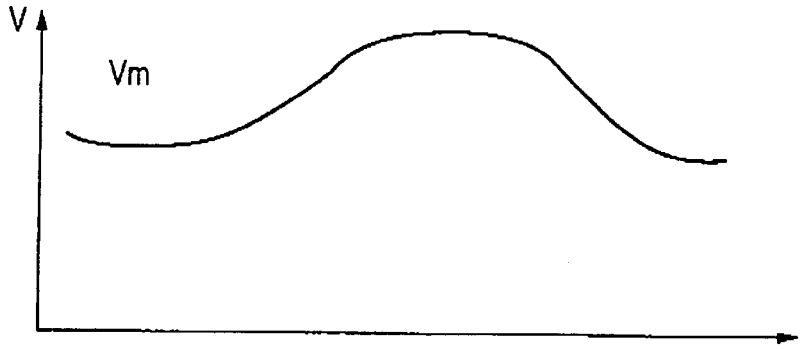
FIG. 5B is a graph showing a profile of the opposite phase of the speed profile.
Figure 5C:
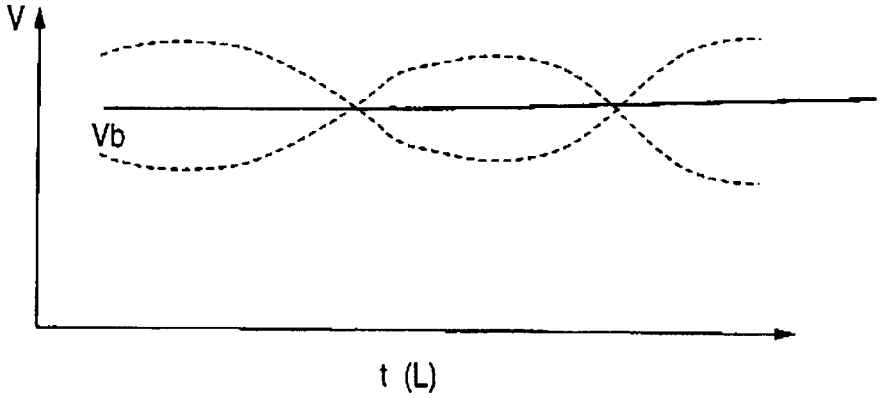
FIG. 5C is a graph showing a speed profile in which the profiles of FIGS. 5A and 5B are negated with each other in superposed relationship with each other.

So, the drive roller 12 which should originally be driven at a constant rotational speed is drive-controlled at a speed fluctuation Vm of the opposite phase, i.e., the driving speed Vm by the drive roller 12, correspondingly to the speed fluctuation amount Vh foreseen from a position synchronized with the home position mark 22. As the result, the speed fluctuations of the two (Vh and Vm) negate each other and the linear speed Vb on the transfer belt 8 becomes constant, and the recording material attracted thereto and conveyed thereby is also conveyed at a constant speed in synchronism. The distributions of these speeds over one round of the belt are shown in FIGS. 5A, 5B and 5C.

Description will now be made as to how to give the drive roller speed Vm correspondingly to the foreseen speed fluctuation amount Vh created by the thickness direction profile over the full circumference foreseen from the position synchronized with the home position mark 22 prescribed by the drive roller 12.

For example, when the drive roller 12 is to be reduction-driven by the use of a gear or a belt provided between it and the vibration motor 20, it is often practiced to usually set the profile of the driving speed Vm to such a trapezoidal type that it is accelerated to a predetermined rotating speed, whereafter the speed is maintained constant, and is then decelerated to come to a halt. As a method of realizing this, to increase and apply a driving pulse rate to the motor at a suitable interval for a while during acceleration, and thereafter maintain the speed Vm constant, a constant pulse rate is given to the motor, and the motor is driven at a predetermined rotating speed, and during deceleration and halt, the pulse rate is added to the motor 20 in the opposite pattern to that during acceleration.

Also, when the driving speed Vm is to be feedback-controlled by the use of an encoder, it is effected to set the speed profile to a trapezoid, and control so as to eliminate a speed difference relative to the trapezoidal speed.

In the present embodiment, when the drive roller 12 is originally driven at the above-mentioned constant pulse rate, with the position detected by the home position mark 22 as the reference, such a speed profile as will negate the speed fluctuation Vh which will be created by the known thickness profile over the direction of full circumference of the transfer belt is calculated in advance, and a drive motor control signal is produced at a pulse rate modulated relative thereto, and the vibration motor 20 is driven on the basis of this control signal to thereby drive the transfer belt, whereby the final speed Vb of the transfer belt can be made free of fluctuation. That is, on the basis of the thickness information of the belt stored in the ROM, the rotating speed of the vibration motor 20 is controlled by a CPU as control means.

Figure 6:
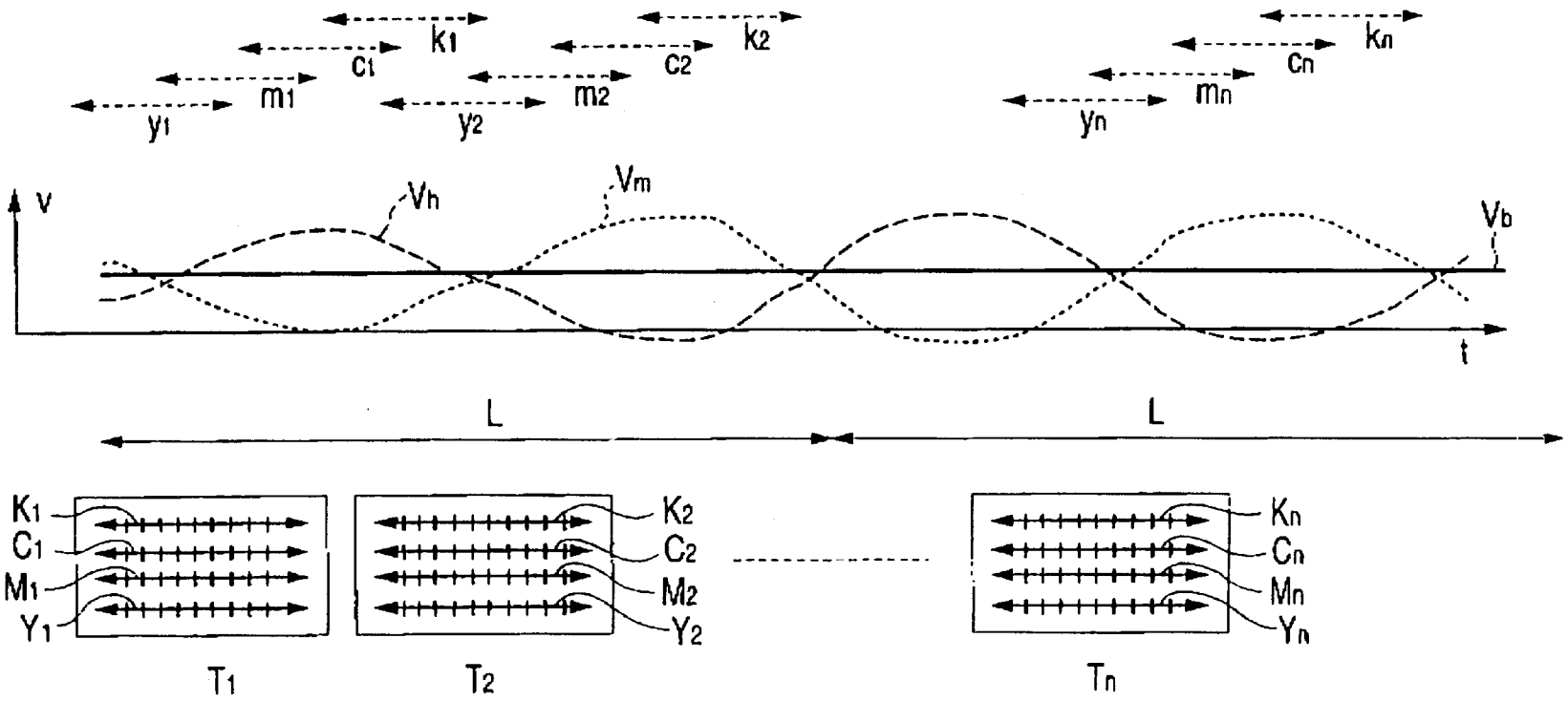
FIG. 6 is a typical view showing a transfer state in Embodiment 1 which is free of positional deviation.

As the result, as shown in FIG. 6, the positions of and the intervals among respective + marks on Y(1–n)–K(1–n) on the same recording materials T1–Tn become equal to one another and the + marks on the plurality of recording materials T1–Tn can also be recorded at equal intervals and at desired positions, and misregister of colors can be prevented.

The process in which the position information (phase) of the transfer belt 8 is detected as follows.

After the home position of the transfer belt 8 was detected at a certain point of time, the pulse of the encoder contained in the motor is counted while the transfer belt 8 rotates through one revolution, whereby the phase of the transfer belt 8 thereafter is recognized. When the transfer belt 8 has rotated through one revoltion, the marking 22 is detected again and therefore, the pulse count is reset and the count is effected again. Thus, slight errors are prevented from cumulating for a long term to thereby make the phase of the transfer belt 8 undetectable.

Embodiment 2

This embodiment is similar to Embodiment 1 except for the following point. That is, the present embodiment discretely measures the thickness data of the transfer belt 3 in the circumferential direction thereof, and on the basis thereof, controls the speed of the transfer belt 8 by the CPU.

Description will first be made of the process in which the thickness data of the transfer belt 8 is measured, and a correcting value used in the apparatus is derived by a predetermined method, and is inputted to the apparatus. The process in which the correcting value used in the apparatus is derived in advance from the thickness data of the transfer belt 8 may be carried out, for example, by an outside computer during manufacture, and in the present embodiment, the correcting value is calculated in the apparatus by a procedure which will be described below when the uneven thickness data is inputted to the apparatus (the apparatus is not effecting image formation).

Figure 7:
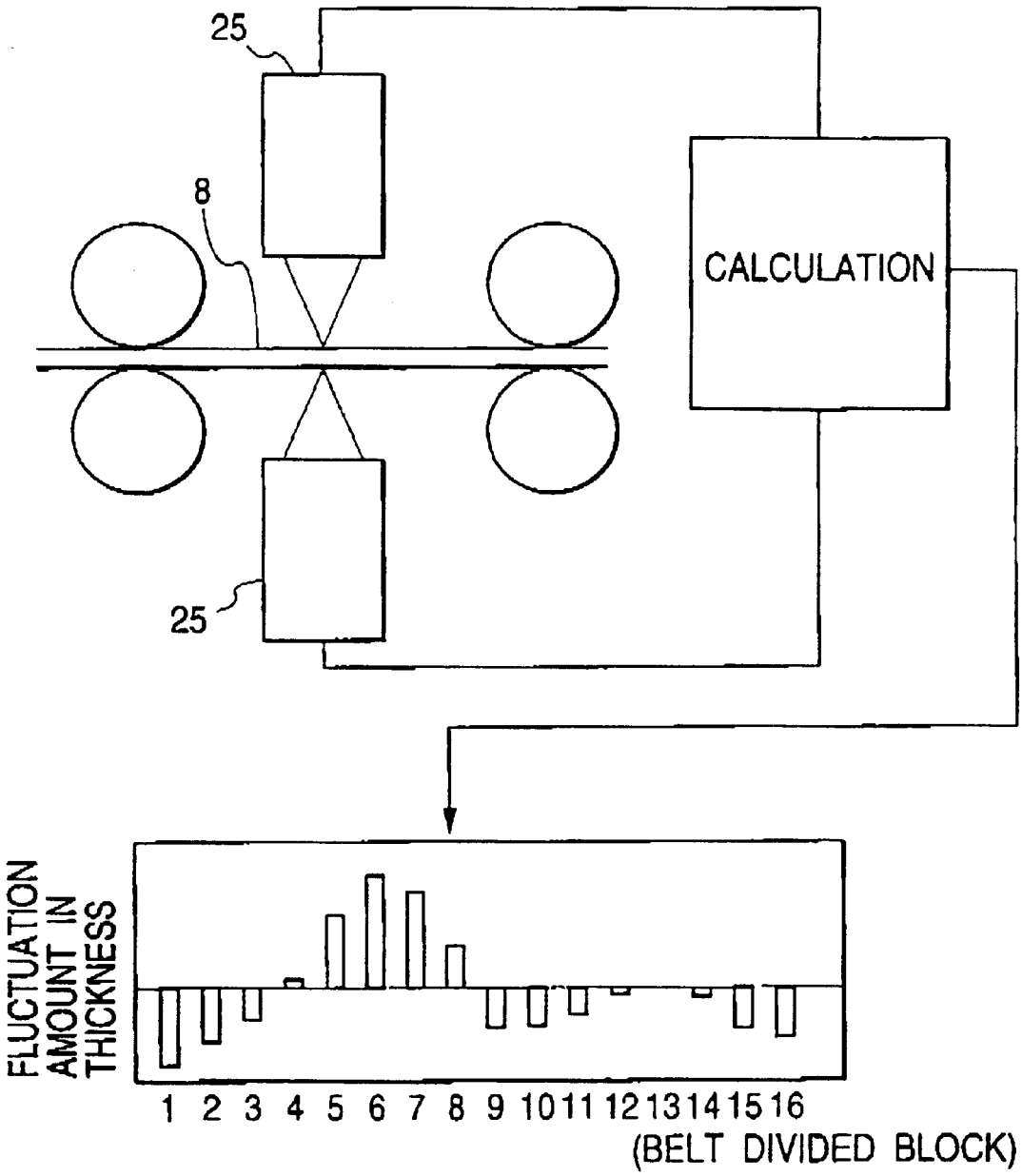
FIG. 7 shows a method of measuring a thickness of a belt member used in the image forming apparatus to which the present invention is applied.

By a method shown in FIG. 7, the thickness of the transfer belt 8 is measured over one round thereof with the home position 22 as the reference. In this embodiment, the thickness data is sampled by a laser displacement meter 25 at 1037 points at every other 1 mm while the transfer belt 8 is being driven at a predetermined speed.

Next, the thickness data is averaged with the circumferential length of the transfer belt 8 divided into 16, and the representative value thereof is found, and the difference thereof from the average value over the full circumference is calculated.

When the thickness data of the belt is to be measured, other position on the belt at which the positional relation with the home position is specified may be used as the reference.

The more finely divided is the circumferential length of the transfer belt (in the present embodiment, if it is divided into e.g. 1037), the more improved is the correction accuracy of the misregistering amount of color, but on the other hand, there arise such problems as the cumbersomeness with which the thickness data is inputted to the apparatus, and much consumption of the memory storing the data therein.

Figure 8:
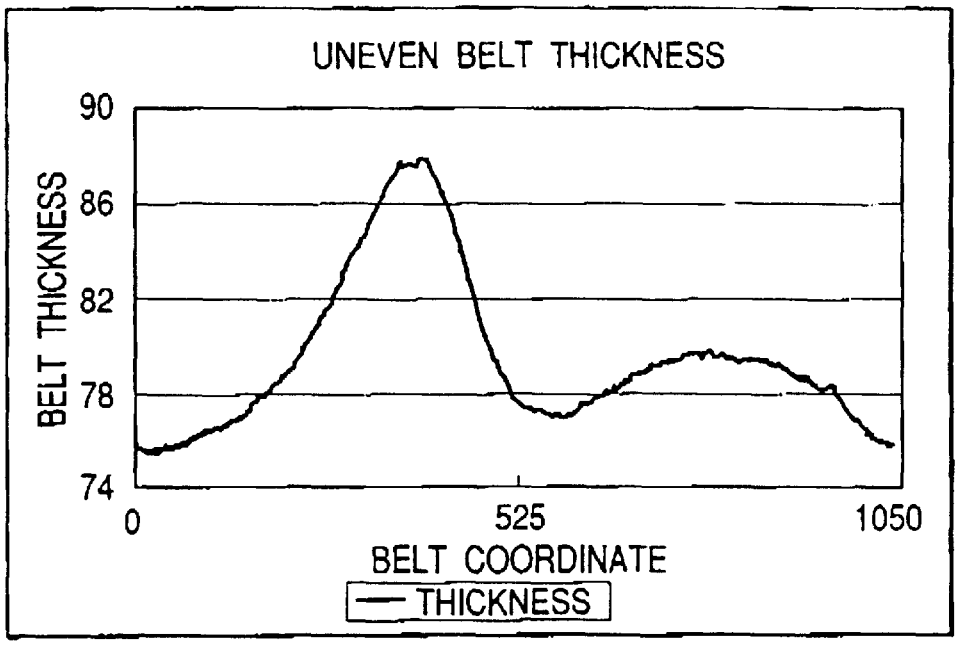
FIG. 8 shows an example of the uneven thickness of the belt member.
Figure 9:
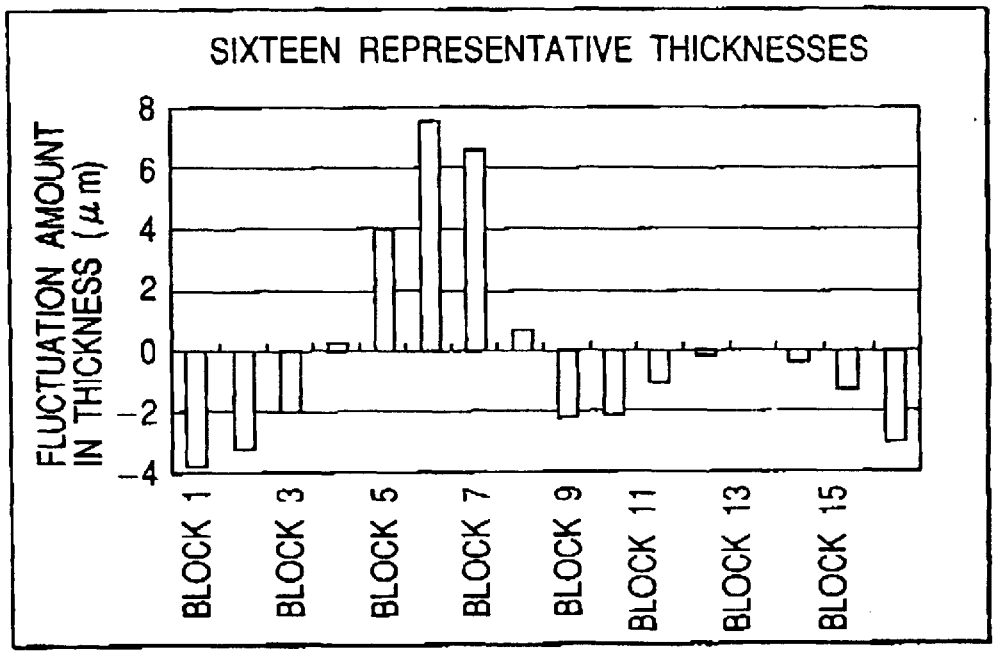
FIG. 9 shows data in which a thickness information of the belt member has been discretely extracted.

In the present embodiment, the transfer belt 8 is divided into 16 and the thickness data thereof is discretely stored and the speed control of the transfer belt 8 is effected, and this has been determined with the controllable speed resolving power of the vibration motor 20 which is a drive source, the CPU load during image formation, the accuracy of the misregister of colors to be corrected, the above-mentioned demerits, etc. taken into account. Sixteen discrete data extracted from the measurement data of the transfer belt 8 shown in FIG. 8 are shown in FIG. 9.

In the present apparatus, when the transfer belt 8 is interchanged during shipping or in the market, a person in charge of maintenance inputs the sixteen thickness data to the memory means (ROM) of the apparatus. At this point of time, the apparatus is in its inoperative state, and calculates a speed correcting parameter in a process which will be described below.

The data of uneven thickness assumes a waveform similar to that of an increase and decrease in the moving linear speed of the transfer belt 8 because the driving effective radius of the belt driving roller 12 is increased or decreased. That is, when the design average thickness of the transfer belt 8 is defined as T and the amount of variation in the thickness of the transfer belt 8 is defined as $\Delta t$ and the design driving effective radius is defined as R, the amount of variation in the radius up to the center of the belt is found by $(\Delta t/2)/(R+T/2)$ and therefore, when the design linear speed of the belt is defined as V, the amount of variation $\Delta v$ in the linear speed of the belt is $$\Delta v = V \times (\Delta t/2)/(R+T/2).$$

Here, a case where the average thickness of the transfer belt 8 over the full circumference thereof deviates from the design central value or a case where the radius of the belt driving roller 12 generally deviates from the design center is also supposed, but all these present themselves as an increase or decrease in the average speed of the belt member and is therefore offset by correcting the exposure timing of the exposure device 15Y–15K of each image forming unit 10Y–10K.

That is, the purpose of the present embodiment is the correction of misregister of colors occurring in the process wherein the transfer belt 8 is moved over one round which is attributable to the uneven thickness (AC component) of the transfer belt and therefore, the present embodiment does not pay attention to the general offset of the thickness of the transfer belt 8 and the radius of the drive roller 12.

As the factor of the fluctuation in the speed of the transfer belt which is AC component attributable to the drive roller 12, there is the previously mentioned eccentricity of the drive roller 12, but the influence thereof, as previously described, is offset in advance by making the distance formed by the respective image forming units 10 in the conveying direction of the belt (the distance between 40Y-40M, 40M-40C and 40C-40K) substantially coincident with the circumferential length of the drive roller 12. However, this is not restrictive, but the aforementioned distance may be made substantially coincident with integer times the circumferential length of the drive roller.

In the present embodiment, the vibration motor 20 driving the belt is such that the encoder is 1000 (pulses per revolution) and the control clock frequency is 10 MHz. Accordingly, at about 73 rpm which is the rotating speed during image formation, the motor 20 has about 14 $\mu$m/sec. as speed control resolving power, and has the above-mentioned speed resolving power × the belt passing time after division, i.e., 7.76 $\mu$m, as misregister correction resolving power.

A process of obtaining a fact that the speed control resolving power equals to above 14 $\mu$m/sec. will be described below.

When the belt is rotated at a speed of 117 mm/sec. (=73 rpm), slits of the encoder generate pulses at a frequency of 1216.7 Hz (=73/60×1000). That is, the slits of the encoder are brought at every other $1/1216.7$ sec. On the other hand, as the control clock frequency is 10 MHz, a passing time period of the slits of the encoder can be detected (and controlled theoretically) with a time accuracy of $1/10000000$ sec.

As the pulses brought at every other $1/1216.7$ sec. (when the speed is 117 mm/sec.) is controlled with the time accuracy of $1/0000000$ sec., the following relationship is established:

$$117 : 1/1216.7 = X : 1/0000000.$$

The following solution is derived from the above relationship:

$$X = 117 \times (1/0000000)/(1/1216.7)$$
$$= 0.0142.$$

That is, the value of about 14 $\mu$m/sec. is derived.

There are the following two processes for obtaining the correcting value, and the latter is higher in correcting capability.

1) Correction is effected within the range of speed correction resolution so that the speed fluctuation value of the transfer belt 8 may approximate to zero.

2) Cumulative misregistering amounts are successively calculated from the speed fluctuation value of the transfer belt 8, and correction is effected within the range of misregister correction resolving power (=speed correction resolving power) so that the cumulative misregistering amount may approximate to zero.

FIG. 10 shows the correcting value calculated from the representative thicknesses at sixteen locations on the transfer belt 8 by the method under item 2) above adopted in the present embodiment. After all, sixteen speed control parameters are obtained in the process wherein the transfer belt 8 is driven.

That the correcting value is +2 means that the target control speed is increased by two steps of the resolving power, and that the correcting value is −1 means that the target control speed is decreased by a step of the resolving power.

The apparatus newly stores in the memory means the correcting value of the target control speed obtained above.

As previously described, in the present apparatus, the marking 22 is detected, whereby the apparatus has the phase information of the transfer belt 8 and therefore, if this correcting value is obtained, it is possible to minimize the misregistering amount of the transfer belt 8 from the ideal position thereof attributable to the uneven thickness of the transfer belt 8 by driving at each of correcting speeds conforming to the areas (hereinafter referred to as the blocks) of the transfer belt 8 divided into 16 which is driven by the drive roller 12 in the process of image formation.

Figure 11:
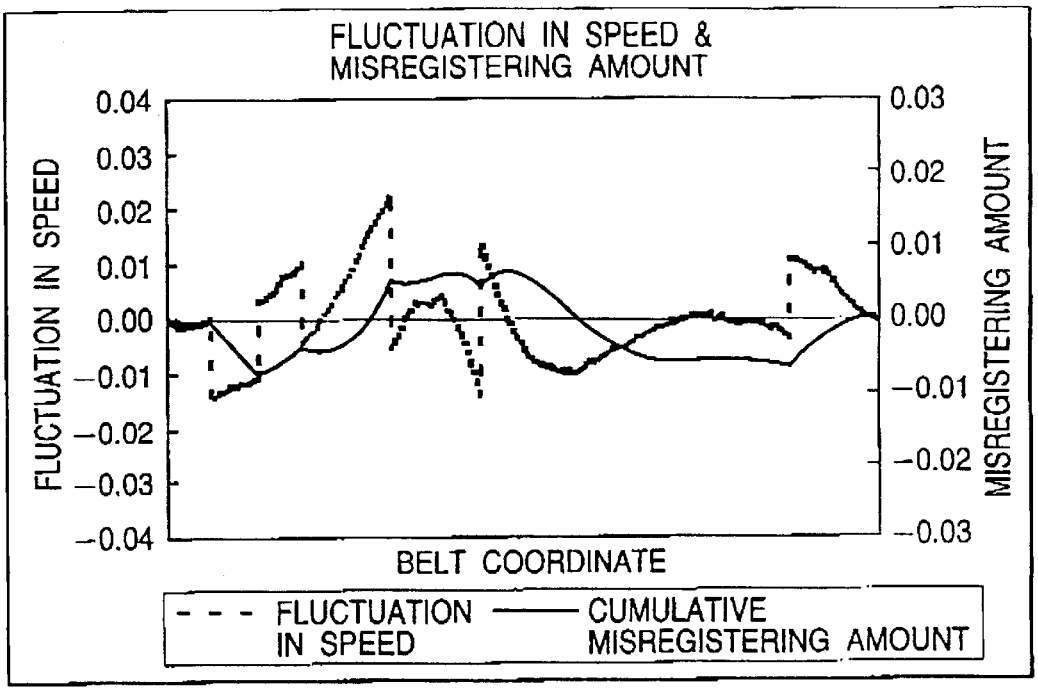
FIG. 11 shows fluctuation of speed after correction of the thickness of the belt member and an amount of misregister from an ideal position of the belt.

FIG. 11 shows the fluctuation in the speed of the transfer belt 8 after the above-described correction and the resulting misregistering amount from the ideal position on the transfer belt 8.

Figure 12:
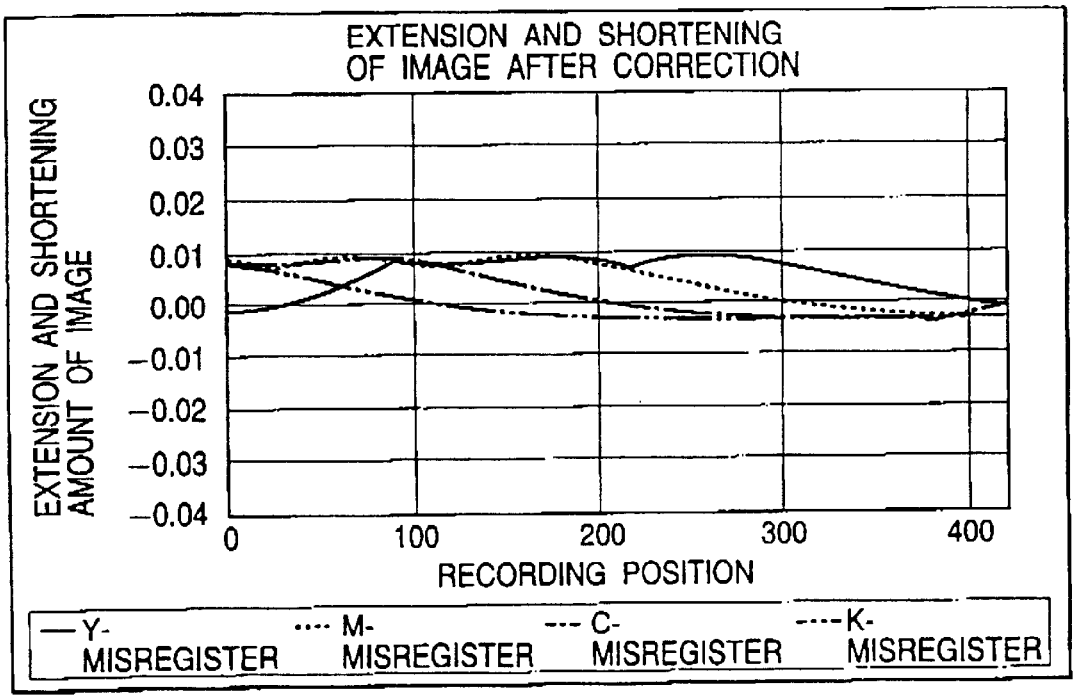
FIG. 12 shows an extension and shortening of images of respective colors appearing when the belt member of FIG. 8 is used.

FIG. 12 shows the misregistering amount of color of the output image when this correction is effected by the transfer belt 8 shown in FIG. 8. Also, FIG. 13 is a graph which has been rewritten by the distance in Y-direction formed by four lines farthest in FIG. 12.

Figure 13:
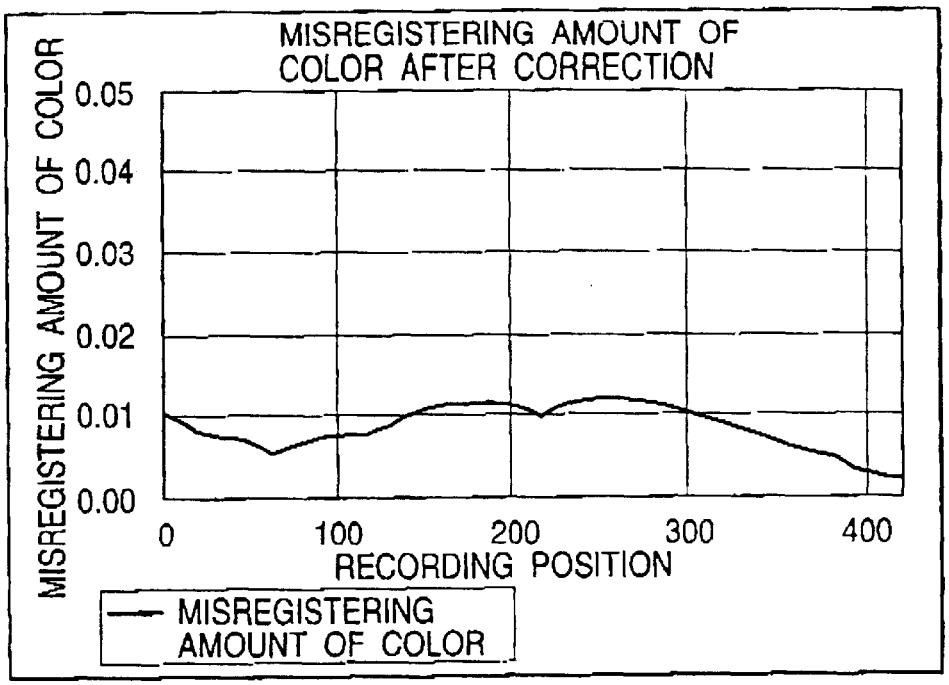
FIG. 13 shows a misregistering amount of color appearing when the belt member of FIG. 8 is used.
Figure 14:
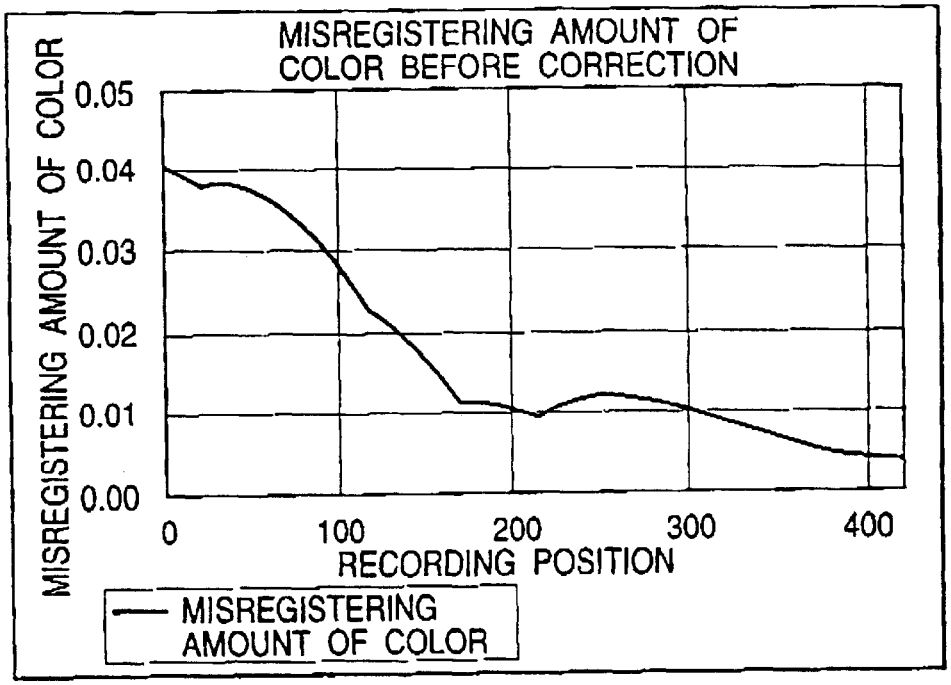
FIG. 14 shows a misregistering amount of color appearing when the belt member of FIG. 8 is used before correction.

It is seen from FIG. 13 that the misregistering amount of color after the correction is 13 $\mu$m or less over the full area of the image, and the misregistering amount of color of about 40 $\mu$m shown in FIG. 14 when correction was not effected by the use of the same transfer belt 8 is greatly reduced.

In the present embodiment, information based on the uneven thickness of the transfer belt 8 is handled as sixteen discrete data and therefore, the capacity of the memory means in the apparatus may be small, and even if the data inputted to the apparatus are few, a great correcting effect can be obtained.

While in the above-described embodiment, color misregister correction control is effected by the use of the sixteen thickness data of the belt, this is not restrictive. It is preferable to effect the correction control of the rotating speed of the drive roller by the use of at least two thickness data for a transfer material used, and in accordance therewith, the numbers of the thickness data of belts used in various apparatuses can be determined.

Embodiment 3

A third embodiment of the present invention will now be described.

The basic construction of this embodiment is similar to that of the previous embodiment and therefore, the image forming process and the method of detecting the phase of the transfer belt 8 need not be described.

The present embodiment differs from Embodiment 2 in that when the speed correcting value of the transfer belt 8 is to be derived from the data of uneven thickness, correction is effected within the range of speed correction resolution so that the value of fluctuation in the speed of the transfer belt 8 may approximate to zero.

In the present embodiment, the fluctuation in speed is calculated from the thickness of the transfer belt 8, and the value of the fluctuation in speed is approximated to zero within the range of control resolving power when it is over the controllable speed resolving power.

Figure 15:
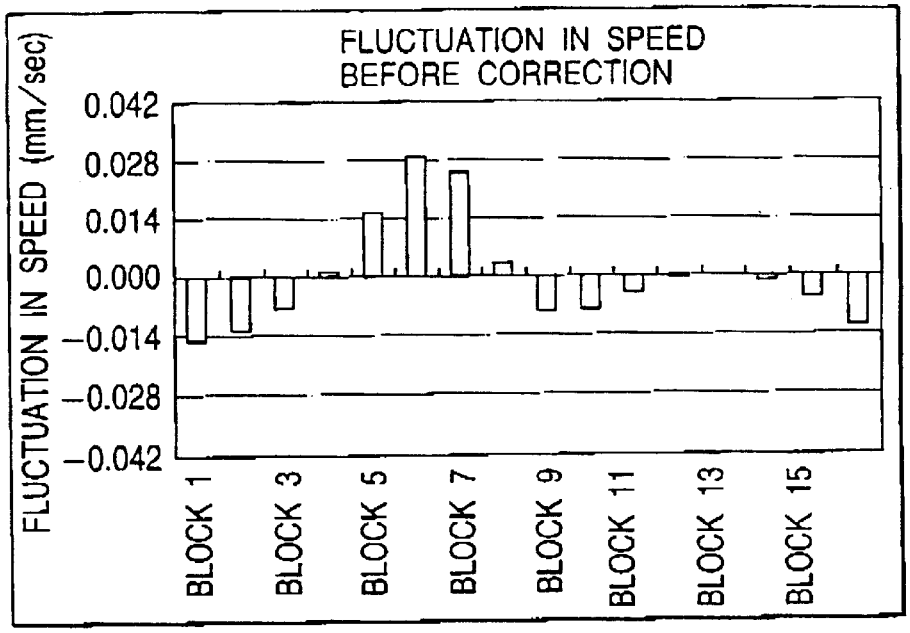
FIG. 15 shows data in which thickness information of the belt member has been discretely extracted.

FIG. 15 shows the fluctuation in speed occurring to the belt which has been calculated from the representative thickness of the same transfer belt 8 as that in the previous embodiment after divided into sixteen blocks.

Since the control resolving power of the vibration motor 20 driving the transfer belt 8 is about 14 $\mu$m/sec. which is the same as the previous one, the target control speed is changed so that the fluctuation in speed after control may approximate to zero at this resolving power.

FIG. 16 shows the speed correcting amount during the driving of each block.

Figure 17:
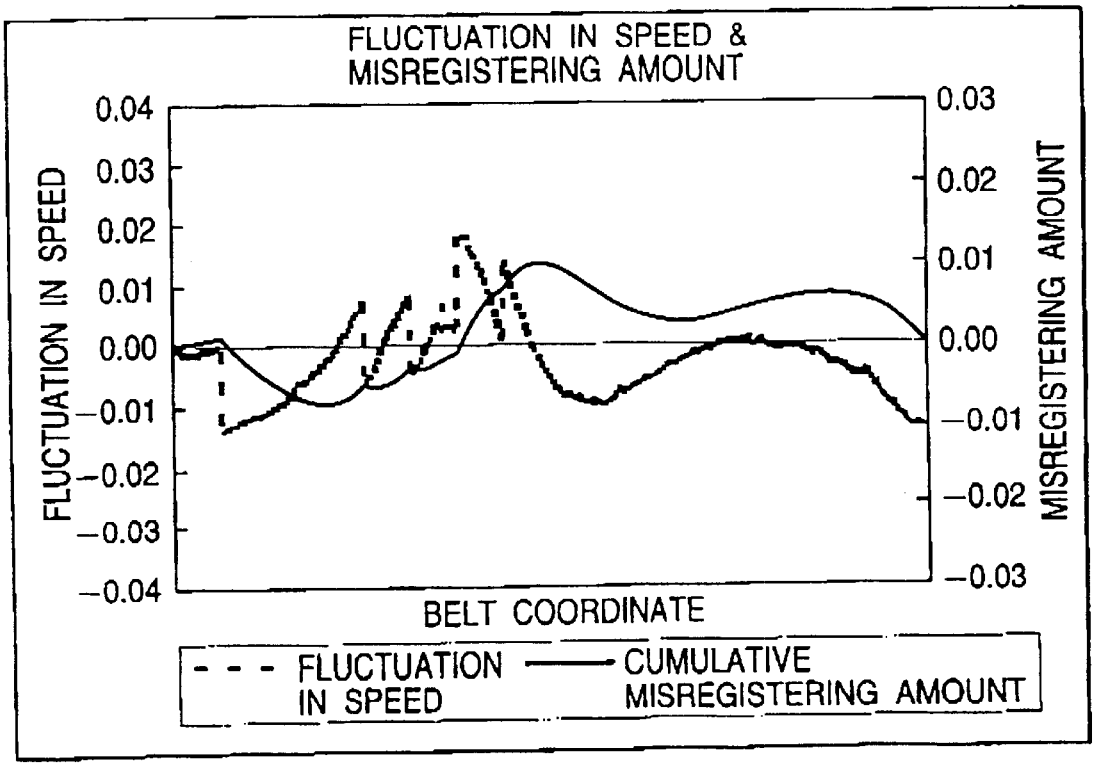
FIG. 17 shows a fluctuation in the speed of the belt after correction and the misregistering amount from the ideal position of the belt.

FIG. 17 shows the fluctuation in speed on the transfer belt 8 after the correction and the misregistering amount from the ideal position on the transfer belt 8.

Figure 18:
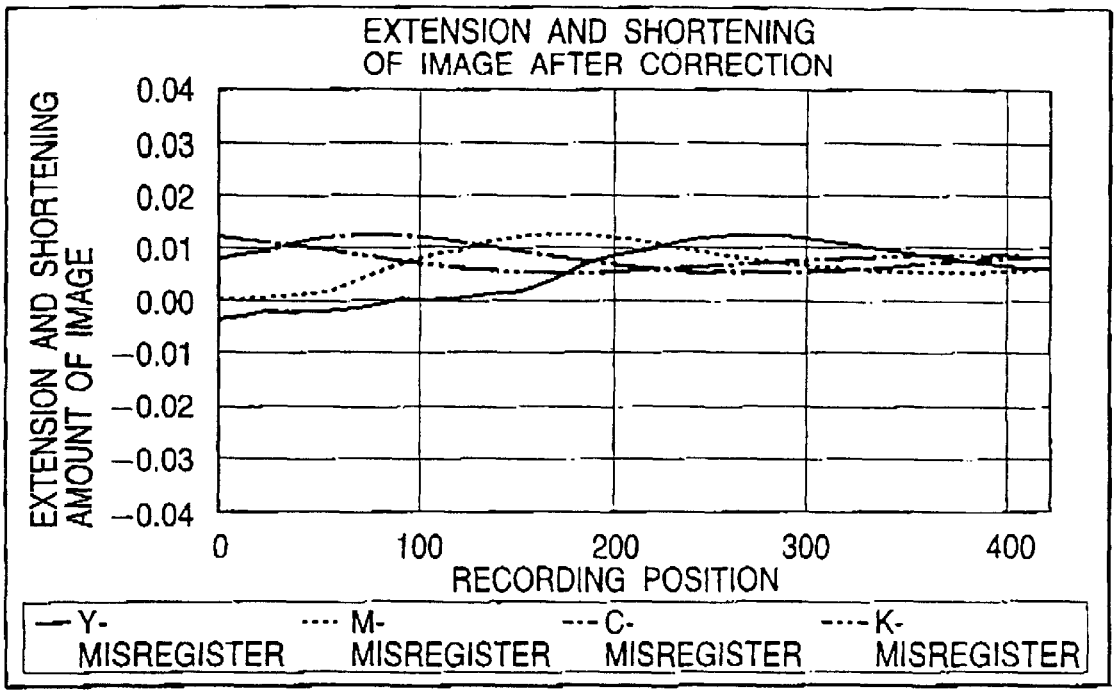
FIG. 18 shows an extension and shortening of the images of respective colors appearing when the belt member of FIG. 8 is used.
Figure 19:
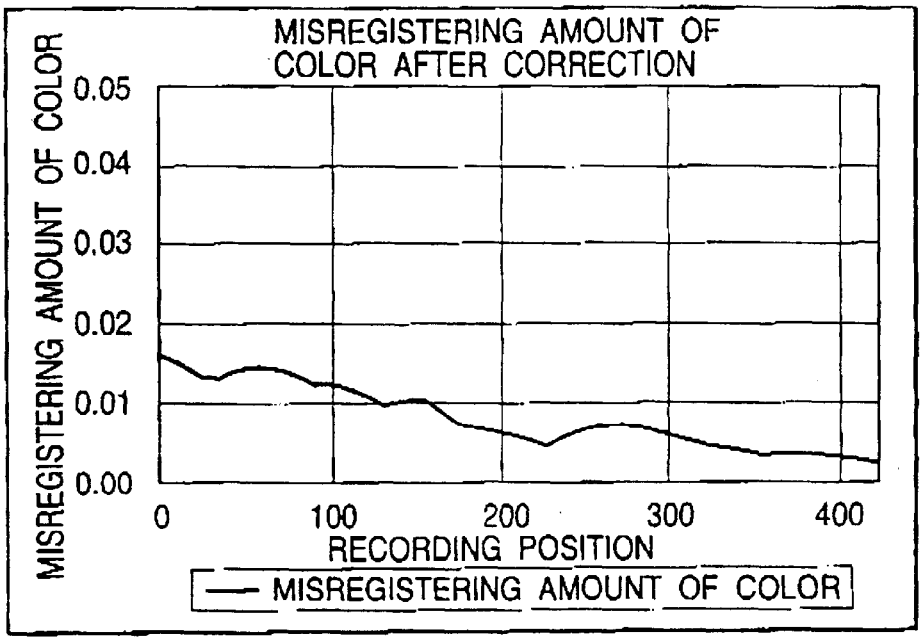
FIG. 19 shows a misregistering amount of color appearing when the belt member of FIG. 8 is used.

As the result, FIG. 18 represents the extension and shortening of each color of the outputted image, and FIG. 19 is a graph which has been rewritten at the distance in Y-direction formed by four lines farthest in FIG. 18.

As shown in FIG. 19, the maximum misregistering amount of color occurring on the image is of the order of 16 $\mu$m, and when correction has not been effected by the same transfer belt 8, it is greatly reduced as compared with 40 $\mu$m shown in FIG. 14.

Embodiment 4

Figure 20:
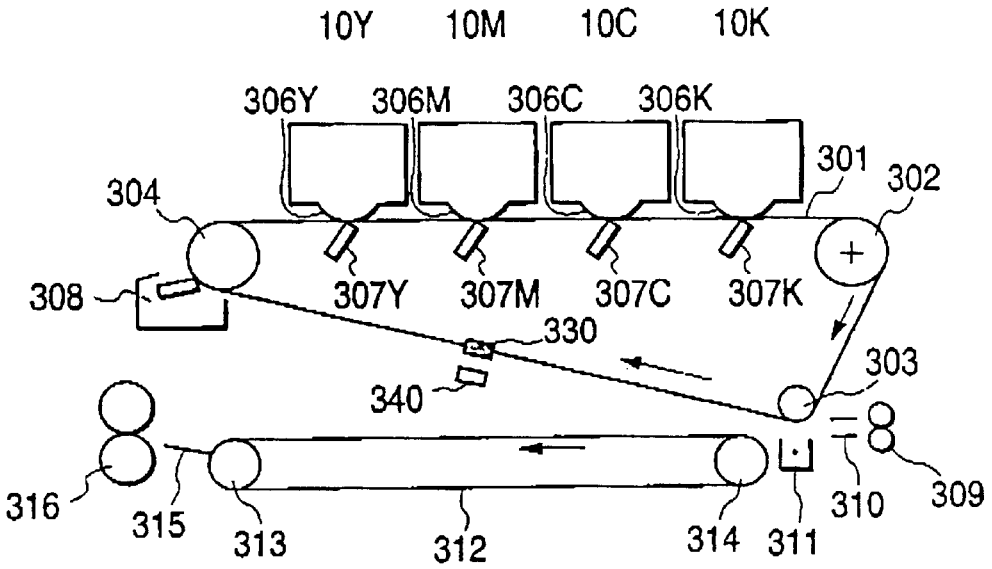
FIG. 20 schematically shows a cross-section of a main body of an image forming apparatus according to Embodiment 4 of the present invention.

FIG. 20 shows a schematic cross-sectional view of the main body of an image forming apparatus according to a fourth embodiment of the present invention.

As shown in FIG. 20, this apparatus is an image forming apparatus of a type in which images formed on an intermediate transfer belt 301 by image forming units 10Y–K of respective colors are collectively transferred onto a recording material.

The distances formed among the image forming units 10Y–K and the diameter of an intermediate transfer belt driving roller 304 are the same as those in the previous embodiment, and the basic construction and operation of the present embodiment are known and therefore need not be described in detail, but yet the schematic image forming process of the present embodiment is as follows.

Latent images corresponding to the respective colors are formed on photosensitive drums 306Y, 306M, 306C and 306K by an image information signal sent from an original reading apparatus (not shown) or an output apparatus (not shown) such as a computer, and thereafter are developed. The images of the respective colors are successively primary-transferred to an intermediate transfer belt 301 by transfer means 307Y–307K, and finally a full color image is formed on the intermediate transfer belt 301.

On the other hand, in synchronism with the above-described image forming process, a recording material is fed out toward a secondary transfer portion at predetermined timing with its skew-feed or the like corrected by a pair of registration rollers 309. In the secondary transfer portion, the full color image on the intermediate transfer belt 301 is electrostatically collectively transferred to the recording material by an opposed roller 303 and a charger 311 below it.

After the secondary transfer, the recording material Is conveyed by a conveying belt 312 and arrives at a pair of fixing rollers 316. The fixing rollers 316 are heated by heaters (not shown), and the toners of the respective colors are thermally fused and fixed on the recording material, whereby a color image is completed. The recording material on the surface of which the toner images have been fixed by the pair of fixing rollers 316 is discharged out of the apparatus.

Again in the present apparatus, the images formed by image forming units 10Y–10K disposed at different places are superposed one upon another on the intermediate transfer belt 301 to thereby form the full color image and therefore, when a fluctuation occurs to the speed of the intermediate transfer belt 301, there arise problems similar to those peculiar to the previous embodiment. That is, in order to decrease the misregistering amount of colors of the image on the intermediate transfer belt 301 attributable to the uneven thickness of the intermediate transfer belt 301, the present embodiment has a sensor 340 for detecting the marking 330 of the intermediate transfer belt 301 during image formation and detecting the phase of the belt 301, and a ROM for storing therein information based on the uneven thickness of the intermediate transfer belt 301, and on the basis of the stored information, the speed of the intermediate transfer belt 301 is controlled in conformity with the phase of the intermediate transfer belt 301 during image formation, whereby as in the previous embodiment, the misregistering amount of color occurring on the intermediate transfer belt 301 or the image thereon is reduced.

Embodiment 5

Figure 21:
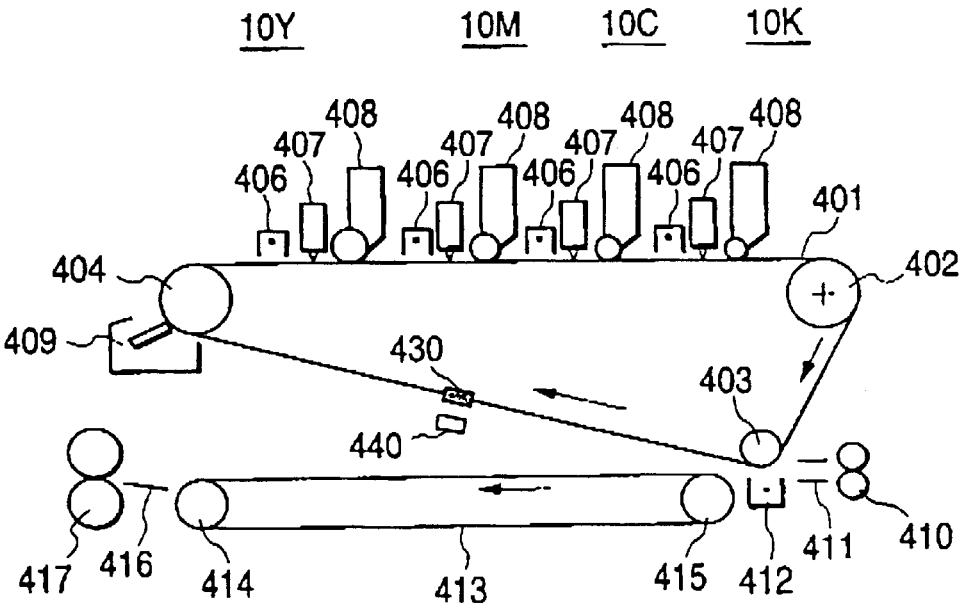
FIG. 21 schematically shows a cross-section of a main body of an image forming apparatus according to Embodiment 5 of the present invention.

FIG. 21 shows a schematic cross-sectional view of a main body of an image forming apparatus according to a fifth embodiment of the present invention.

As shown in FIG. 21, this apparatus is an image forming apparatus of a type in which images formed on a photosensitive belt 401 by image forming units 10Y–K of the respective colors are collectively transferred onto a recording material.

The distance between adjacent ones of the image forming units 10 and the diameter of a photosensitive belt driving roller 404 are the same as those in the previous embodiment, and the basic construction and operation of the present embodiment are known and therefore need not be described in detail, but the schematic image forming process is as follows.

Latent images corresponding to the respective colors are formed on the photosensitive belt 401 by an image information signal sent from an original reading apparatus (not shown) or an output apparatus (not shown) such as a computer, and thereafter are successively developed, whereby a full color image is formed on the photosensitive belt 401.

On the other hand, in synchronism with the above-described image forming process, a recording material is fed out toward a transfer portion at predetermined timing with its skew-feed or the like corrected by a pair of registration rollers 410. In the transfer portion, the full color image on the photosensitive belt 401 is electrostatically collecting transferred to the recording material by an opposed roller 403 and a charger 412 below it.

After the transfer, the recording material is conveyed by a conveying belt 413 and arrives at a pair of fixing rollers 417. The fixing rollers 417 are heated by heaters (not shown), and the toners of the respective colors are thermally fused and fixed on the recording material, whereby a color image is completed. The recording material on the surface of which the toner images have been fixed by the pair of fixing rollers 417 is discharged out of the apparatus.

Again in this apparatus, the images formed by the image forming units disposed at different places are successively superposed one upon another on the photosensitive belt 401 to thereby form the full color image and therefore, when a fluctuation occurs to the speed of the photosensitive belt 401, there arise problems similar to those peculiar to the previous embodiment. That is, in order to decrease the registering amount of color of the image on the photosensitive belt 401 attributable to the uneven thickness of the photosensitive belt 401, the present embodiment has a sensor 440 for detecting the marking 430 of the photosensitive belt 401 during image formation and detecting the phase of the photosensitive belt 401, and a ROM for storing therein information based on the uneven thickness of the photosensitive belt 401, and on the basis of the stored information, the speed of the photosensitive belt 401 is controlled In conformity with the phase of the photosensitive belt during image formation, whereby as in the previous embodiment, the misregistering amount of color occurring on the photosensitive belt or the image thereon is reduced.

Embodiment 6

Embodiment 6 will now be described with reference to FIGS. 22A, 22B, 22C and 22D.

In the present embodiment, marks similar to the home position mark 22 are provided at N locations, whereby it is possible to impart other information than the position information, e.g. robot control information in the rough classification of the thickness profile.

For example, three marks 22A–22C are imparted, whereby four kinds of information can be imparted, for example, by a combination of a case where the mark reflection level is High and a case where the mark reflection level is Low. However, it is to be understood that the mark 22A has High information without fail.

Figure 22A:
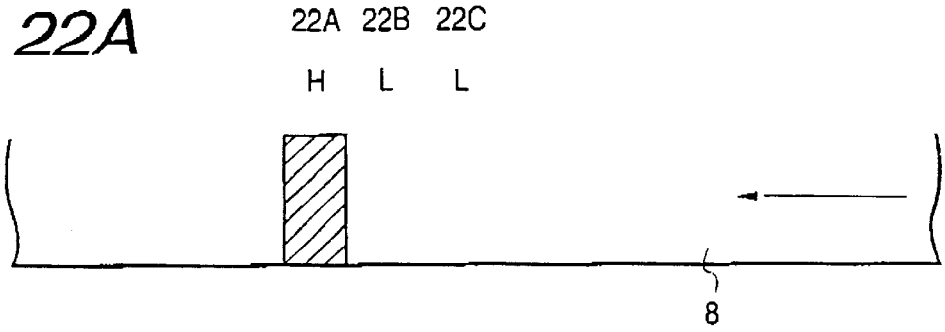
FIGS. 22A, 22B, 22C and 22D are four kinds of typical views showing a combination of home position marks 22A, 22B and 22C on the belt.
Figure 22B:
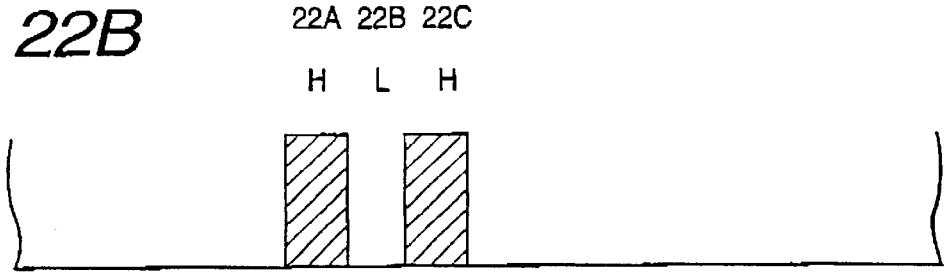
Figure 22C:
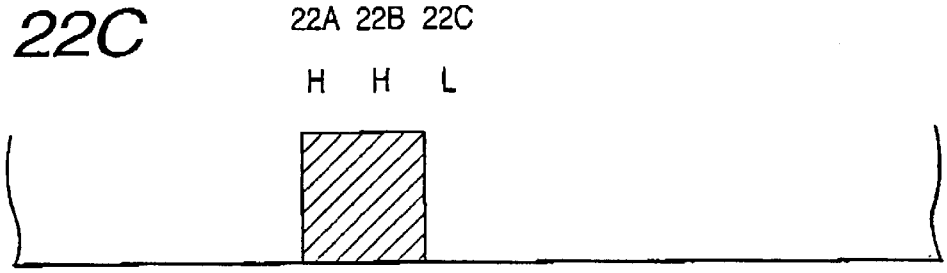
Figure 22D:
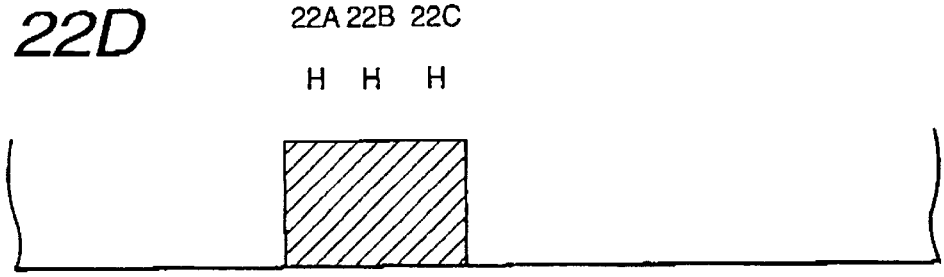
Figure 23:
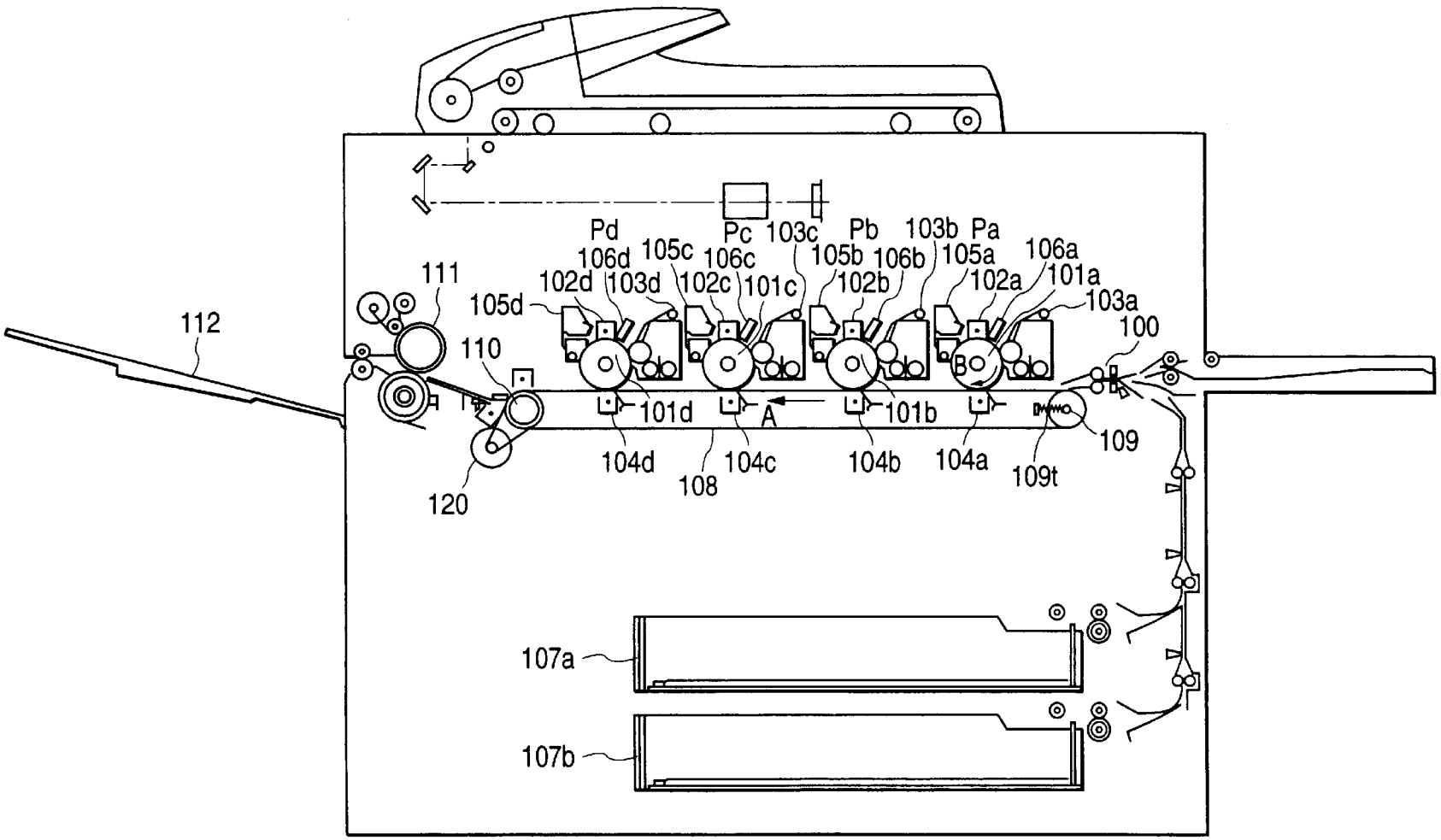
FIG. 23 PRIOR ART
FIG. 23 shows a general construction of an example of an image forming apparatus.
Figure 24:
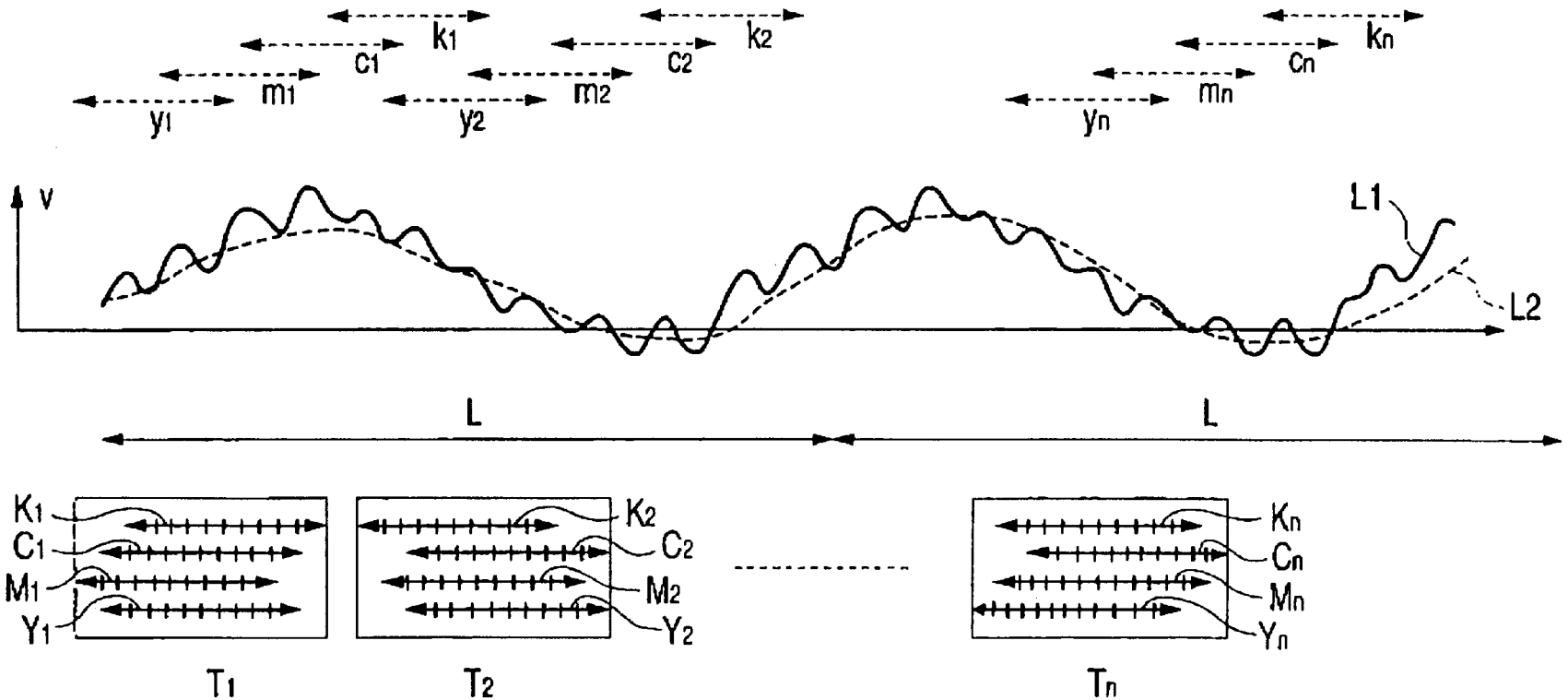
FIG. 24 is a typical view showing a misregister of images of respective colors caused by fluctuation in speed of the belt.

That is, there are four kinds, i.e., in FIG. 22A, 22A:High-22B:Low-22C:Low, in FIG. 22B, 22A:High-22B:LOW-22C:High, in FIG. 22C, 22A:High-22B:High-22C:Low, and in FIG. 22D, 22A:High-22B:High-22C:High.

Embodiment 7

In the above-described embodiments, the user or the person in charge of maintenance inputs the thickness information of the belt written on a label packed with the belt to the ROM of the apparatus by input means such as an upper liquid crystal display portion, and renews the thickness information by the CPU, whereas this is not restrictive, but a bar-code (thickness information) written on the end portion of the belt (the non-image forming area) may be inputted by the use of a bar-code reading machine connected to the apparatus.

As described above, even when the belt has been interchanged, the thickness information already stored in the ROM can be renewed, and the speed of the belt can be controlled well.

Not only the thickness information of the belt, but serial numbers for controlling and specifying individual belts are written.

Also, in the above-described embodiments, the drive motor for the drive roller has been described as a vibration motor, whereas this is not restrictive, but the motor may be a motor of other type such as a DC servo motor.

In order to effect the control of the rotating speed of the drive roller in the above-described embodiments, a memory medium storing therein the program code of software renewing from the initial thickness data of the belt stored in the memory means as during the interchange of the belt to new thickness data is supplied to the image forming apparatus, and the computer (CPU) of the image forming apparatus reads out and executes the program code stored in the memory medium, whereby the control is achieved.

In this case, the program code itself read out from the memory medium realizes the novel function of the present invention, and the memory medium storing the program code therein constitutes the present invention.

As the memory medium for supplying the program code, use can be made, for example, of a floppy disc, a hard disc, an optical disc, a magneto-optical disc, CD-ROM, CD-R, a magnetic tape, a non-volatile memory card, a ROM, a DVD or the like.

Also, the present invention covers a case where by executing the program code read out by the computer, not only the control of the rotating speed of the drive roller is realized, but on the basis of the Instructions of the program code, an OS (operating system) or the like operating on the computer effects part or the whole of actual processing, and the function of the above-described embodiments is performed by the processing.

Further, the present invention covers a case where the program code read out from the memory medium is written into a memory provided in a function expanding board inserted in the computer a function expanding unit connected to the computer, whereafter on the basis of the instructions of the program code, a CPU or the like provided in the function expanding board or the function expanding unit effects part or the whole of actual processing, and the function of the above-described embodiments is realized by the processing.

Also, the program code itself installed in the computer to realize the function processing of the present invention by the computer realizes the present invention. That is, the claims of the present invention also cover the computer program itself for realizing the function processing of the present invention.

What is claimed is:

1. An image forming apparatus comprising:

a plurality of image bearing members;

image forming means for forming images of plural colors on said plurality of image bearing members respectively;

a recording material conveying belt for bearing and conveying a recording material thereon;

a drive roller for transmitting a driving force to said recording material conveying belt, the images of plural colors on said plurality of image bearing members formed by said image forming means being successively transferred to the recording material borne on said recording material conveying belt in superposed relationship with one another; and control means for controlling a rotating speed of said drive roller on a basis of information on thickness of said recording material conveying belt in a direction of movement of said recording material conveying belt, said thicknesses being measured prior to installation of said recording material conveying belt into said image forming apparatus.

2. An image forming apparatus according to claim 1, further comprising memory means for storing the information on thickness of said recording material conveying belt therein.

3. An image forming apparatus according to claim 2, further comprising detecting means for detecting a predetermined position of said recording material conveying belt.

4. An image forming apparatus according to claim 3, wherein said control means controls the rotating speed of said drive roller on a basis of said information stored in said memory means and a result of detection by said detecting means.

5. An image forming apparatus according to claim 4, wherein said memory means stores therein the information on thickness of said recording material conveying belt in the direction of movement thereof measured with a certain position of said recording material conveying belt as a reference.

6. An image forming apparatus according to claim 5, wherein in the direction of movement of said recording material conveying belt, said predetermined position and said certain position of said recording material conveying belt are spaced apart by a predetermined distance from each other.

7. An image forming apparatus according to claim 4, wherein said memory means stores therein the thickness information of said recording material conveying belt in the direction of movement thereof measured with said predetermined position of said recording material conveying belt as a reference.

8. An image forming apparatus according to claim 3, further comprising a drive source for giving a driving force to said drive roller.

9. An image forming apparatus according to claim 8, wherein said control means controls the driving force of said drive source on a basis of said information stored in said memory means and a result of detection by said detecting means.

10. An image forming apparatus according to claim 8, wherein said drive source is a vibration motor.

11. An image forming apparatus according to claim 10, wherein said control means controls a driving frequency given to said vibration motor on the basis of said information stored in said memory means and the result of the detection by said detecting means.

12. An image forming apparatus according to claim 1, further comprising a roller for giving tension to said recording material conveying belt.

13. An image forming apparatus according to any one of claims 2 to 12, wherein said control means controls the rotating speed of said drive roller on a basis of at least two pieces of information of said recording material conveying belt in the direction of movement thereof stored in said memory means to form an image on a single recording material.

14. An image forming apparatus according to any one of claims 1 to 12, further comprising:

a plurality of exposing means for exposing charged surfaces of said plurality of image bearing members to thereby form latent images thereon respectively; and a plurality of developing means for developing the latent images on said plurality of image bearing members formed by said plurality of exposing means with toners.

15. An image forming apparatus according to claim 14, wherein after a predetermined time has passed after an exposure has been started by a first one of said plurality of exposing means, an exposure is started by a second one of said plurality of exposing means.

16. An image forming apparatus according to claim 15, wherein exposure starting intervals by said plurality of exposing means are substantially equal to each other.

17. An image forming apparatus according to claim 16, wherein in the direction of movement of said recording material conveying belt, a distance from a position at which an image is transferred from a first one of said plurality of image bearing members to the recording material borne on said recording material conveying belt to a position at which an image is transferred from a second one of said plurality of image bearing members to the recording material borne on said recording material conveying belt is substantially equal to integer times a circumferential length of said drive roller.

18. An image forming apparatus according to claim 17, wherein in the direction of movement of said recording material conveying belt, said distance is substantially equal to the circumferential length of said drive roller.

19. An image forming apparatus comprising:

a belt member;

a drive roller for transmitting a driving force to said belt member;

image forming means for successively superposing and forming images of plural colors on said belt member, the images of plural colors formed on said belt member by said image forming means being transferred to a recording material; and control means for controlling a rotating speed of said drive roller on a basis of information on thickness of said belt member in a direction of movement of said belt member, said thicknesses being measured prior to installation of said belt member into said image forming apparatus.

20. An image forming apparatus according to claim 19, further comprising memory means for storing therein the information on thickness of said belt member in the direction of movement of said belt member.

21. An image forming apparatus according to claim 20, further comprising detecting means for detecting a predetermined position of said belt member.

22. An image forming apparatus according to claim 21, wherein said control means controls the rotating speed of said drive roller on a basis of said information stored in said memory means and a result of detection by said detecting means.

23. An image forming apparatus according to claim 22, wherein said memory means stores therein the information on thickness of said belt member in the direction of movement thereof measured with a certain position of said belt member as a reference.

24. An image forming apparatus according to claim 23, wherein in the direction of movement of said belt member, said predetermined position and said certain position of said belt member are spaced apart by a predetermined distance from each other.

25. An image forming apparatus according to claim 22, wherein said memory means stores therein the thickness information of said belt member in the direction of movement thereof measured with said predetermined position of said belt member as a reference.

26. An image forming apparatus according to claim 21, further comprising a drive source for giving a driving force to said drive roller.

27. An image forming apparatus according to claim 26, wherein said control means controls the driving force of said drive source on a basis of said information stored in said memory means and a result of detection by said detecting means.

28. An image forming apparatus according to claim 26, wherein said drive source is a vibration motor.

29. An image forming apparatus according to claim 28, wherein said control means controls a driving frequency given to said vibration motor on the basis of said information stored in said memory means and the result of the detection by said detecting means.

30. An image forming apparatus according to claim 19, further comprising a roller for giving tension to said belt member.

31. An image forming apparatus according to any one of claims 20 to 30, wherein said control means controls the rotating speed of said drive roller on a basis of at least two pieces of information of said belt member in the direction of movement thereof stored in said memory means to form an image on a single recording material.

32. An image forming apparatus according to any one of claims 19 to 30, further comprising;

a plurality of image searing members;

a plurality of exposing means for exposing charged surfaces of said plurality of image bearing members to thereby form latent images thereon respectively; and a plurality of developing means for developing the latent images on said plurality of image bearing members formed by said plurality of exposing means with toners.

33. An image forming apparatus according to claim 32, wherein after a predetermined time has passed after an exposure has been started by a first one of said plurality of exposing means, an exposure is started by a second one of said plurality of exposing means.

34. An image forming apparatus according to claim 33, wherein exposure starting intervals by said plurality of exposing means are substantially equal to each other.

35. An image forming apparatus according to claim 34, wherein in the direction of movement of said belt member, a distance from a position at which an image is transferred from a first one of said plurality of image bearing members to said belt member to a position at which an image is transferred from a second one of said plurality of image bearing members to said belt member is substantially equal to integer times a circumferential length of said drive roller.

36. An image forming apparatus according to claim 35, wherein in the direction of movement of said belt member, said distance is substantially equal to the circumferential length of said drive roller.

37. An image forming apparatus according to any one of claims 19 to 30, further comprising:

a plurality of exposing means for exposing charged surface of said belt member to thereby form latent images thereon respectively; and a plurality of developing means for developing the latent images on said belt member formed by said plurality of exposing means with toners.

38. An image forming apparatus according to claim 37, wherein said belt member is a photosensitive member.

39. An image forming apparatus according to claim 38, wherein after a predetermined time has passed after an exposure has been started by a first one of said plurality of exposing means, an exposure is started by a second one of said plurality of exposing means.

40. An image forming apparatus according to claim 39, wherein exposure starting intervals by said plurality of exposing means are substantially equal to each other.

41. An image forming apparatus according to claim 40, wherein in the direction of movement of said belt member, a distance from a position at which an image is formed on said belt member by a first one of said plurality of developing means to a position at which an image is formed on said belt member by a second one of said plurality of developing means is substantially equal to integer times a circumferential length of said drive roller.

42. An image forming apparatus according to claim 41, wherein in the direction of movement of said belt member, said distance is substantially equal to the circumferential length of said drive roller.

43. An image forming apparatus comprising:

a plurality of image bearing members;

image forming means for forming images of plural colors on said plurality of image bearing members respectively;

a recording material conveying belt for bearing and conveying a recoding material thereon;

a drive roller for transmitting a driving force to said recording material conveying belt, the images of plural colors on said plurality of image bearing members formed by said image forming means being successively transferred to the recording material borne on said recording material conveying belt in superposed relationship with one another;

control means for controlling a rotating speed of said drive roller on a basis of information on thickness of said recording material conveying belt in a direction of movement of said recording material conveying belt;

memory means for storing the information on thickness of said recording material conveying belt therein; and detecting means for detecting a predetermined position of said recording material conveying belt;

wherein said control means controls the rotating speed of said drive roller on the basis of the information on thickness stored in said memory means and a result of detection by said detecting means, and wherein said memory means stores therein the information on thickness of said recording material conveying belt in the direction of movement thereof measured with a certain position of said recording material conveying belt as a reference.

44. An image forming apparatus according to claim 43, wherein in the direction of movement of said recording material conveying belt, said predetermined position and said certain position of said recording material conveying belt are spaced apart by a predetermined distance from each other.

45. An image forming apparatus according to claim 43, wherein said memory means stores therein the thickness information of said recoding material conveying belt in the direction of movement thereof measured with said predetermined position of said recording material conveying belt as a reference.

46. An image forming apparatus according to any one of claims 43 to 45, wherein said control means controls the rotating speed of said drive roller on a basis of at least two pieces of information of said recording material conveying belt in the direction of movement thereof stored in said memory means to form an image on a single recoding material.

47. An image forming apparatus according to any one of claims 43 to 45, further comprising:

a plurality of exposing means for exposing charged surfaces of said plurality of image bearing members to thereby form latent images thereon respectively; and a plurality of developing means for developing the latent images on said plurality of image bearing members formed by said plurality of exposing means with toners.

48. An image forming apparatus according to claim 47, wherein after a predetermined time has passed after an exposure has been started by a first one of said plurality of exposing means, an exposure is started by a second one of said plurality of exposing means.

49. An image forming apparatus according to claim 48, wherein exposure starting intervals by said plurality of exposing means are substantially equal to each other.

50. An image forming apparatus according to claim 49, wherein in the direction of movement of said recording material conveying belt, a distance from a position at which an image is transferred from a first one of said plurality of image bearing members to the recording material borne on said recording material conveying belt to a position at which an image is transferred from a second one of said plurality of image bearing members to the recording material born on said recording material conveying belt is substantially equal to integer times a circumferential length of said drive roller.

51. An image forming apparatus according to claim 50, wherein in the direction of movement of said recording material conveying belt, said distance is substantially equal to the circumferential length of said drive roller.

52. An image forming apparatus comprising:

a belt member;

a drive roller for transmitting a driving force to said belt member;

image forming means for successively superposing and forming images of plural colors on said belt member, the images of plural colors formed on said belt member by said image forming means being transferred to a recording material;

control means for controlling a rotating speed of said drive roller on a basis of information on thickness of said belt member in a direction of movement of said belt member;

memory means for storing therein the information on thickness of said belt member in the direction of movement of said belt member;

detecting means for detecting a predetermined position of said belt member;

wherein said control means controls the rotating speed of said drive roller on the basis of the information on thickness stored in said memory means and a result of detection by said detecting means, and wherein said memory means stores therein the information on thickness of said belt member in the direction of movement thereof measured with a certain position of said belt member as a reference.

53. An image forming apparatus according to claim 52, wherein in the direction of movement of said belt member, said predetermined position and said certain position of said belt member are spaced apart by a predetermined distance from each other.

54. An image forming apparatus according to claim 52, wherein said memory means stores therein the information on thickness of said belt member in the direction of movement thereof measured with said predetermined position of said belt member as a reference.

55. An image forming apparatus according to any one of claims 52 to 54, wherein said control means controls the rotating speed of said drive roller on a basis of at least two pieces of information of said belt member in the direction of movement thereof stored in said memory means to form an image on a single recording material.

56. An image forming apparatus according to any one of claims 52 to 54, further comprising:

a plurality of image bearing members;

a plurality of exposing means for exposing charged surfaces of said plurality of image bearing members to thereby form latent images thereon respectively; and a plurality of developing means for developing the latent images on said plurality of image bearing members formed by said plurality of exposing means and toners.

57. An image forming apparatus according to claim 56, wherein after a predetermined time has passed after an exposure has been started by a first one of said plurality of exposing means, an exposure is started by a second one of said plurality of exposing means.

58. An image forming apparatus according to claim 57, wherein exposure starting intervals by said plurality of exposing means are substantially equal to each other.

59. An image forming apparatus according to claim 58, wherein in the direction of movement of said belt member, a distance from a position at which an image is transferred from a first one of said plurality of image bearing members to said belt member to a position at which an image is transferred from a second one of said plurality of image bearing members to said belt member is substantially equal to integer times a circumferential length of said drive roller.

60. An image forming apparatus according to claim 59, wherein in the direction of movement of said belt member, said distance is substantially equal to the circumferential length of said drive roller.

61. An image forming apparatus according to any one of claims 52 to 54, further comprising:

a plurality of exposing means for exposing charged surface of said belt member to thereby form latent images thereon respectively; and a plurality of developing means for developing the latent images on said belt member formed by said plurality of exposing means with toners.

62. An image forming apparatus according to claim 61, wherein said belt member is a photosensitive member.

63. An image forming apparatus according to claim 62, wherein after a predetermined time has passed after an exposure has been started by a first one of said plurality of exposing means, an exposure is started by a second one of said plurality of exposing means.

64. An image forming apparatus according to claim 63, wherein exposure starting intervals by said plurality of exposing means are substantially equal to each other.

65. An image forming apparatus according to claim 64, wherein in the direction of movement of said belt member, a distance from a position at which an image is formed on said belt member by a first one of said plurality of developing means to a position at which an image is formed on said belt member by a second one of said plurality of developing means is substantially equal to integer times a circumferential length of said drive roller.

66. An image forming apparatus according to claim 65, wherein in the direction of movement of said belt member, said distance is substantially equal to the circumferential length of said drive roller.

* * * * *

UNITED STATES PATENT AND TRADEMARK OFFICE

CERTIFICATE OF CORRECTION

PATENT NO. : 6,324,355 B1
DATED : November 27, 2001
INVENTOR(S) : Norio Matsui et al.

It is certified that error appears in the above-identified patent and that said Letters Patent is hereby corrected as shown below:

Column 3,
Line 45, "Also" should read -- Also, --.

Column 12,
Line 50, "Is" should read -- is --.

Column 14,
Line 3, "In" should read -- in --.

Column 15,
Line 4, "Instructions" should read -- instructions --.

Column 17,
Line 67, "comprising;" should read -- comprising: --.

Column 18,
Line 1, "searing" should read -- bearing --.

Column 19,
Line 65, "born" should read -- borne --.

Signed and Sealed this

Nineteenth Day of March, 2002

*Attest:*

*Attesting Officer*

JAMES E. ROGAN
*Director of the United States Patent and Trademark Office*